US009975742B1

(12) United States Patent
Mason et al.

(10) Patent No.: US 9,975,742 B1
(45) Date of Patent: May 22, 2018

(54) APPARATUS AND METHODS FOR MONITORING AND CONTROLLING A WINCH

(71) Applicant: Superwinch, LLC, Dayville, CT (US)

(72) Inventors: Jon G. Mason, Old Saybrook, CT (US); Scott D. Peterson, Northborough, MA (US)

(73) Assignee: Superwinch, LLC, Dayville, CT (US)

( * ) Notice: Subject to any disclaimer, the term of this patent is extended or adjusted under 35 U.S.C. 154(b) by 530 days.

(21) Appl. No.: 14/735,674

(22) Filed: Jun. 10, 2015

Related U.S. Application Data

(60) Provisional application No. 62/010,154, filed on Jun. 10, 2014.

(51) Int. Cl.
*B66D 1/12* (2006.01)

(52) U.S. Cl.
CPC ..... *B66D 1/12* (2013.01)

(58) Field of Classification Search
CPC .... B66D 1/46; B66D 1/48; B66D 2700/0125; B66D 2700/0141
See application file for complete search history.

(56) References Cited

U.S. PATENT DOCUMENTS 4,004,780 A 1/1977 Kuzarov
4,475,163 A 10/1984 Chandler et al.
5,995,347 A 11/1999 Rudd et al.
D489,157 S 4/2004 Lawson
6,864,650 B2 3/2005 Heravi et al.
6,882,917 B2 * 4/2005 Pillar ..... A62C 27/00 180/65.27
6,885,920 B2 * 4/2005 Yakes ..... A62C 27/00 180/65.1
D513,650 S 1/2006 Elliott
7,063,306 B2 * 6/2006 Sanders ..... B66D 1/485 254/361
D532,577 S 11/2006 Elliott et al.
7,184,866 B2 * 2/2007 Squires ..... A62C 27/00 340/426.15
7,201,366 B2 4/2007 Sanders et al.
D550,923 S 9/2007 Huang
D555,874 S 11/2007 Elliott et al.
7,392,122 B2 * 6/2008 Pillar ..... A62C 27/00 701/22
7,511,443 B2 3/2009 Townsend et al.
7,770,847 B1 * 8/2010 Severson ..... A63H 19/24 246/1 C
7,891,641 B1 2/2011 Miller
(Continued)

OTHER PUBLICATIONS

U.S. Appl. No. 15/590,850, filed May 9, 2017, Frazier.
(Continued)

*Primary Examiner* — Emmanuel M Marcelo
(74) *Attorney, Agent, or Firm* — Perkins Coie LLP

(57) ABSTRACT

An apparatus and methods for monitoring and/or controlling electric powered winches has sensors for measuring operational parameters of the winch. A programmed computer obtains the sensor data and issues notifications to the user of the associated parameters. The computer may be a hand-held device, such as a mobile phone, which receives the sensor data wirelessly. In some embodiments, the wireless device may also be used to issue operational commands to the winch.

32 Claims, 18 Drawing Sheets

(56) References Cited

U.S. PATENT DOCUMENTS

| | | | | |
|---|---|---|---|---|
| 8,055,403 | B2 * | 11/2011 | Lowrey | G01C 21/26 701/31.5 |
| 8,076,885 | B2 | 12/2011 | Heravi et al. | |
| 8,248,230 | B2 * | 8/2012 | Covaro | H02J 13/0003 340/12.32 |
| D670,660 | S | 11/2012 | Cook | |
| 8,306,690 | B2 * | 11/2012 | Bertness | B60L 3/0046 701/22 |
| D685,750 | S | 7/2013 | Nakagawa | |
| 8,554,440 | B1 * | 10/2013 | Davis | B60K 28/16 701/82 |
| D703,414 | S | 4/2014 | Fretz et al. | |
| 8,944,217 | B2 * | 2/2015 | Anasis | B66D 1/605 182/148 |
| 9,014,913 | B2 | 4/2015 | Heravi et al. | |
| D741,038 | S | 10/2015 | Huang | |
| 9,315,364 | B2 * | 4/2016 | Averill | B66D 1/12 |
| D766,843 | S | 9/2016 | Fretz et al. | |
| 9,537,335 | B2 * | 1/2017 | Furui | B25F 5/02 |
| D784,934 | S | 4/2017 | Fretz et al. | |
| 9,779,557 | B2 * | 10/2017 | Hauser | G07C 5/008 |
| 9,810,704 | B2 * | 11/2017 | Holmes | G01N 35/0092 |
| 2002/0156574 | A1 | 10/2002 | Fortin | |
| 2008/0166430 | A1 | 7/2008 | Doyle et al. | |
| 2009/0284877 | A1 | 11/2009 | Heravi et al. | |
| 2010/0319910 | A1 | 12/2010 | Ives et al. | |
| 2011/0065546 | A1 | 3/2011 | Xie et al. | |
| 2013/0154821 | A1 | 6/2013 | Miller et al. | |
| 2013/0304278 | A1 * | 11/2013 | Chen | G06F 17/00 701/2 |
| 2014/0001427 | A1 | 1/2014 | Fretz et al. | |
| 2014/0257631 | A1 * | 9/2014 | Heravi | B66D 1/42 701/36 |
| 2015/0191334 | A1 | 7/2015 | Heravi et al. | |
| 2016/0046468 | A1 * | 2/2016 | Heravi | B66D 1/40 715/835 |
| 2016/0311667 | A1 | 10/2016 | Huang | |
| 2016/0311668 | A1 | 10/2016 | Huang | |
| 2017/0062148 | A1 | 3/2017 | Legel | |

OTHER PUBLICATIONS

U.S. Appl. No. 15/640,091, filed Jun. 30, 2017, Dennis.
U.S. Appl. No. 29/563,917, filed May 9, 2016, Frazier.
U.S. Appl. No. 29/563,921, filed May 9, 2016, Frazier.
U.S. Appl. No. 29/579,766, filed Oct. 3, 2016, August.
"Automotive Winch Instruction Manual," Comeup Industries Inc., http://www.comeup.com/Archive/_eng/all_pdf_eng/Comeup_Automotive_Winch_Instruction_Manual-eng.pdf, Aug. 1, 2013, 22 pages.
"The Comeup Cone Brake Structure," Comeup USA, http://comeupusa.com/2017/04/the-comeup-cone-brake-structure/, Apr. 28, 2017, 2 pages.
Superwinch, "Superwinch SI Industrial Winches," YouTube, https://www.youtube.com/watch?v=bMiDddvCZgs>, accessed Nov. 21, 2016, 1 page.

* cited by examiner

G1

G2

APPARATUS AND METHODS FOR MONITORING AND CONTROLLING A WINCH

CROSS-REFERENCE TO RELATED APPLICATIONS

The present application claims the benefit of U.S. Provisional Application No. 62/010,154, filed Jun. 10, 2014, entitled, "Apparatus and Methods For Monitoring and Controlling A Winch," which is incorporated by reference herein in its entirety for all purposes.

FIELD

The present disclosure relates to winches, and more particularly, to winches driven by an electric motor and those using a solenoid contactor to intermediate between the electric motor and a source of electrical power.

BACKGROUND

Winches are often used to lift or pull heavy loads requiring substantial force and tension on the winch cable, rope, belt or chain (all encompassed by the term "cable" as used herein). The load may need to be lifted above the ground or overhead, or may be on a slope or lodged in a depression or mud, as when extracting a vehicle from a stuck position in rough terrain. The load may be subjected to a counterforce, e.g., the current of a river acting on a boat. In general, because the forces involved in winching may be large, it is desirable for the winch to operate reliably, not be subjected to overloading or fail to support the load at any point in its operation. In many instances, winch operators rely upon their senses of sight, hearing, smell and touch to monitor the operation and condition of a winch, the winch motor, the cable and the load. In order to use the senses for this purpose, the winch operator must be in close proximity to the winch, which is not always advantageous for a number of reasons. For example, it may be desirable to operate a winch when the user is positioned in a vehicle to which the winch is attached. Winches are known, e.g., as shown in U.S. Pat. No. 6,864,650 to Heravi et al., wherein a microcontroller and a set of MOSFET switches is used to prevent over-temperature conditions, overload, etc. of the winch motor. Notwithstanding prior approaches, improved and/or alternative winch designs, controllers, apparatus and methods remain desirable.

SUMMARY

The disclosed subject matter relates to a device for controlling a winch with an electric motor driven by electricity that passes through a switching device having an ON state in which electricity flows through the electric motor and an OFF state in which electricity does not flow through the electric motor. The device includes a base unit electrically connected to the switching device and capable of controlling the switching device; a control panel in communication with the base unit, the control panel sending control signals to the base unit in response to user input and the base unit receiving the control signals and responsively controlling the switching device; a display in communication with the base unit and visible to a user; and at least one sensor sensing an operating parameter of the winch, the sensor having an output interpretable by the base unit and displayable on the display to apprise the user of the operating parameter.

In accordance with another embodiment, a hand-held unit is in communication with the base unit, the hand-held unit having the control panel that sends the control signals to the base unit and the display displaying the operating parameter to the user.

In accordance with another embodiment, the base unit has a transceiver and the hand-held unit has a transceiver supporting wireless communication between the base unit and the hand-held unit.

In accordance with another embodiment, the control panel and the display are presented on a touch sensitive display that displays a virtual control panel in proximity to the display of the operating parameter.

In accordance with another embodiment, the hand-held device is a wireless telephone with access to a telephonic network and connection to the Internet.

In accordance with another embodiment, a server computer is connected to the Internet, the server computer having access to data pertaining to winch data and communicating the winch data to the hand-held device, the server computer capable of receiving data from the hand-held device.

In accordance with another embodiment, the at least one sensor is a temperature sensor and senses on the temperature of the electric motor.

In accordance with another embodiment, a plurality of sensors include a current sensor sensing on the electrical current flow through the electric motor.

In accordance with another embodiment, a second switching device determining a polarity of the electricity that passes through the electric motor and a direction that the electric motor spins.

In accordance with another embodiment, the switching device includes a relay.

In accordance with another embodiment, the hand-held unit is redundant to another unit communicating with the base unit and having a second control panel and a second display.

In accordance with another embodiment, the wireless telephone is programmed to analyze winch performance and notify the user concerning limits of winch performance as the winch is used.

In accordance with another embodiment, a method for controlling a winch with an electric motor driven by a source of electricity that passes through a switching device having an ON state in which electricity flows through the electric motor and an OFF state in which electricity does not flow through the electric motor, includes the steps of providing a base unit, the base unit having a microprocessor and a transceiver; electrically connecting the base unit to the electrical switching device, outputs from the base unit controlling the ON/OFF state of the switching device; providing a hand-held unit, the hand-held unit having a microprocessor, a transceiver and a display, the transceivers of the base unit and the hand-held unit supporting wireless communication between the base unit and the hand-held unit, the hand-held unit having a control panel; providing at least one sensor sensing an operating parameter of the winch, the sensor having an output interpretable by the computer of the base unit; establishing a wireless connection between the hand-held unit and the base unit; entering commands on the control panel of the hand-held unit, the microprocessor of the hand-held unit converting the commands into wirelessly transmissible control signals interpretable by the base unit; receiving sensor data from the sensor in the microprocessor of the base unit; converting the sensor data into wirelessly transmissible sensor data interpretable by the hand-held unit; transmitting the control signals from the hand-held unit to the base unit; receiving the control signals into the base unit; the microprocessor of the base unit interpreting the control signals and generating outputs to the switching device, the outputs controlling the ON/OFF state of the switching device; transmitting the sensor data from the base unit to the hand-held unit; and displaying the operating parameter on the display to apprise a user.

In accordance with another embodiment, the sensor data includes electrical current draw, wherein the hand-held unit is a programmed telecommunication device connectable to the Internet and further including the steps of providing a server computer with winch data accessible through the Internet, the winch data including a power curve for the winch approximated by an equation expressed in terms of electrical current draw; receiving the electrical current draw sensor data and the equation power curve data into the programmed telecommunication device; inferring with the programmed telecommunications device at least one of the load or winch speed from the equation and the sensor data; and displaying the inferred value to the user.

In accordance with another embodiment, further including the step of developing the power curve including, plotting test data noted during empirical testing of a winch on a graph resulting in an empirical lime; and fitting a line having an associated equation to the empirical line.

In accordance with another embodiment, the fitted line has an associated equation of the point-slope form.

In accordance with another embodiment, the fitted line has an associated equation of the polynomial or exponential type.

In accordance with another embodiment, further including the steps of cumulatively recording winch operating parameter data on the hand-held device; and comparing the operating parameter data to known operational boundary conditions; and notifying a user of the winch concerning the operational state of the winch via the hand-held unit.

In accordance with another embodiment, further including the steps of uploading the operating parameter data to the server computer; recording the operating parameter data; and responsively contacting the user of the winch when an operational limit of the winch is approached.

In accordance with another embodiment, the steps of uploading and recording are conducted multiple times for multiple users, resulting in a database from which generalized characteristics of a particular winch can be observed based upon actual use.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

Figure 1:
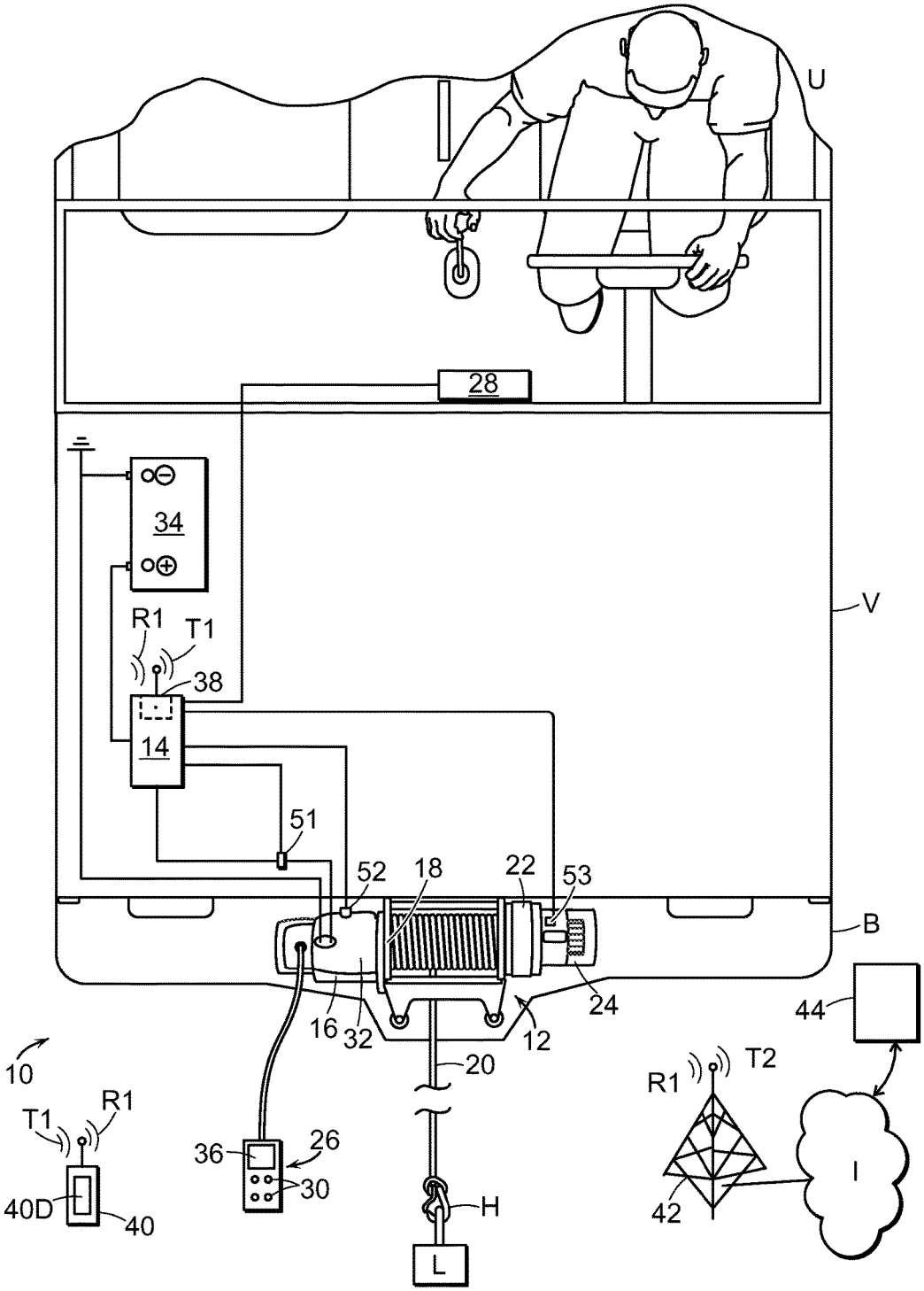
FIG. 1 is a schematic view of a winch and monitoring system in accordance with an embodiment of the present disclosure.

An aspect of the present disclosure is the recognition that accurately monitoring a winch's electric motor for assessing operating parameters and condition and communicating that data to a winch user/operator may lead to more effective winch operation, greater reliability, improved safety and may result in extending the operational life of the winch. FIG. 1 shows a winch system 10 wherein a winch 12 may be controlled by a controller 14. The winch 12 may be a commercially available product, such as one of the winches available from Superwinch LLC of Dayville, Conn., USA, e.g., a Talon® Series Winch or another commercially available winch featuring an electric motor 16 for turning a drum 18 about which a cable 20 is wound. The cable 20 may be provided with a hook H for connecting to a load L or a stationary object against which the winch cable 20 is pulled to move a vehicle V, the winch 12 being mounted to or proximate the bumper B thereof. There are many other purposes for winches, other than for use in conjunction with vehicles and all such other purposes are comprehended by the present disclosure. The winch may have a gear reduction assembly 22 and brake 24. A hand-held, wired remote controller 26 or a cabin mounted controller 28 may be used activate the winch 12. More particularly, the hand-held wired remote controller 26 and or cabin mount controller may have one or more switches 30 to turn the winch motor 16 ON and OFF. In some embodiments, the motor 16 may be reversible, allowing the winch drum 18 to be turned in both rotary directions corresponding to winching the cable 20 IN (Winch In) and OUT (Winch Out). Similar switches to switches 30 may be provided on a cabin-mounted controller 26. The switches 30 are low power switches which then activate one or more solenoid contactors within solenoid assembly 32. Solenoid controlled contactors are a relay, viz., a switch capable of conducting a large current controlled by a smaller switch, e.g., 30 using a low level current to magnetically control the position of the larger switch. Solenoid contactors for reversible winches 12 may direct current from a battery 34 or other source of electrical power through the motor 16 in either of two directions, allowing the motor 16 to be driven in a clockwise or counter-clockwise direction, as well as having an OFF position. In this manner, the winch 12 may either be run to Winch IN or Winch OUT or be turned OFF. The brake 24 may be applied when the winch is turned OFF or may optionally be used in Winching OUT. The solenoid contactor controlled winch has been known for many years. These non-digital winch mechanisms do not provide any status indication beyond ON/OFF (OPEN/CLOSED).

In accordance with an embodiment of the present disclosure, one or more sensors S1, S2, S3 may be provided to monitor operating parameters and/or properties of the winch 12, such as motor 16 temperature (sensor S2), gear reduction assembly 26 oil temperature (sensor S3), brake 24 temperature (sensor not shown) or rate of electrical current flow (sensor S1) to the motor 16. The sensors S1-S3 may be commercially obtained analog sensors, such as a thermistor to measure the temperature of the motor 16 or a shunt resistor and voltmeter to measure current draw. The analog signal from the sensors S1-S3 may then be transmitted to the controller 14 for conversion to a digital signal via analog-to-digital converters and for programmatic interpretation and display, e.g., in graphic symbology on the display 36 of hand-held remote controller 26 or a display on cabin-mounted controller 28. The controller 14 may be programmed merely to convert the sensed data from sensors S1-S3 into graphical/textural/numeric information for observation by the user U, allowing the user U to be in informed control of the winch, even to the point of exceeding the operational boundaries of the winch 12. In one embodiment, the controller 14 takes no action/asserts no control over the winch 12, e.g., based on fault detection. In certain applications, it is preferable for human judgment to be pre-eminent and to be exercised over and above any automatic actions taken by the controller 14. In these embodiments, a human will be empowered to make this judgment and automatic shutdown will not occur in any circumstance. In some embodiments, the apparatus and methods of the present disclosure may be used a warning system only, that does not interfere with actual winch operation. Circumstances may require winching at a force/load level or duration which places the electric motor at risk, but in some circumstances, the negative consequences of an automatic stoppage of power would be greater than a burned-out motor. In these instances, embodiments of the present disclosure allow the user to apply best practices. In another alternative, the programmed controller 14 may exert some control over the winch 12, e.g., controlling the power supplied to the motor 16 and/or the application of the brake 24, e.g., upon sensing parameters that are an indication of reaching an operational limit. In another embodiment, automatic actions taken by the controller 14 may be over-ridden by an express human over-ride command.

In another aspect of the present disclosure, the controller 14 may incorporate a radio transmitter and/or receiver (transceiver) 38 for transmitting signals T1 that may be received by a wireless device 40, such as a cell phone, PDA, netbook, tablet computer or laptop computer. The controller 14 transceiver 38 may also receive signals R1 transmitted by the wireless device 40. In this manner, a local wireless network allowing the controller 14 and the wireless device 40 to communicate is established. The controller 14 may utilize the signals T1 to communicate the digital data representing the sensed data from sensors S1-S3 to the wireless device 40 which is programmed with a program (Application or App) that presents the data from the transmission T1 on a display 40D on the wireless device 40. The sensor S1, S2, S3 data may be conveyed to a circuit board featuring a wireless networking chip. The sensors S1, S2, S3 may be connected to a circuit board with logic chips programmed with firmware within the controller 14 that allow the collected data to be forwarded to a wireless device 40 via a local, secure wireless network. In one example, network information will flow as such: all commands are packetized with 2-byte length, 2-byte command, 16 byte password, up to 1436 bytes of data and 4 byte CRC. The length byte includes the command, data, and CRC. These packets are sent to the TCP level in the stack for transmission. The wireless device 40 may therefore be used to apprise users U of winch 12 of the condition and operating parameters of the winch 12, as it is working. In addition to receiving transmissions T1 from the controller 14, the wireless device 40 may also be programmed to present a user interface, e.g., on a touch-sensitive display 40D that allows the user to issue commands to the controller 14 via signals R1, that can be interpreted by the controller 14 to issue commands to the winch 12. For example, the controller 14 may operate the solenoid contactors in solenoid unit 32 to cause the winch 12 to winch IN, winch OUT, turn OFF, apply brake 24, etc. In this manner, a wireless device 40, such as a cell phone, may be used as a wireless remote control for the winch 12. Since the communication between the controller 14 and the wireless device 40 is wireless, the wireless device 40 may be positioned anywhere in the locale of the winch 12 within the range of the local network established between wireless device 40 and controller 14. This local network may be secure to prevent intrusion or interference by other signals that may exist in the vicinity, e.g. extraneous signals from other devices unrelated to the system 10. A wireless device application may be written and posted to a publically available "App Store" that users could download for the purpose of interpreting and sending commands to controller 14. Such apps are written in the device's native language such as Android or Apple's iOS. Running such apps in conjunction with controller 14 would allow wireless device 40 to become the primary controller of the winch in addition to becoming a new interpreter of winch sensor data and data extrapolated from firmware algorithms. The wireless device 40 may be carried outside the vehicle V by the user U to allow the user to control the winch 12 while viewing the winching operation from an advantageous perspective. When desired, the user U may carry the wireless device 40 into the vehicle V or carry the wireless device 40 with him when he is pushing the vehicle V from the rear. The data from sensors S1, S2, S3 may be provided over a secure wireless network and displayed on a compatible networked device graphically for the user while operating the winch 12. The data sensed and displayed allows the user to maintain an awareness of winch performance and alter winching operation as conditions demand.

An aspect of the present disclosure is that the wireless device 40 and/or wired controllers 26, 28, have the capability of providing measured parameters to the user U, as the user U operates the winch 12 and also provides a user interface to operate the winch 12. In this manner, the device/controllers 26, 28, 40 may provide feedback and insight into winch 12 condition as the user U operates the winch 12 from the same device. In another alternative, the data concerning winch 12 condition, may be displayed in a first device, e.g., wireless device 40 while the user U operates the winch 12 through the user interface of another control device, e.g., 26 or 28. For example, the user U may operate the winch 12 via the cabin-mounted controller 28, while visualizing winch 12 condition on the wireless device 40 that is held in a holster or bracket proximate the cabin-mounted controller 28. In addition to graphic displays, the sensed winch condition, may be expressed on the wireless or wired devices 26, 28, 40 via an audible signal, such as a sound with a varying volume or pitch, or a spoken message. The present disclosure therefore provides an alternative to sensing winch 12 condition by use of the senses of sight, touch or smell, which may or may not be effective, depending upon the conditions and the personal attributes of the user U and also require the user U to be physically positioned relative to the winch 12.

In accordance with an embodiment of the present disclosure, the wireless device 40 may be capable of communicating with a larger communications network, e.g., a wireless phone network, represented by cell tower 42. The communications network 42 may include connection to the Internet I, such that the sensor data and/or commands received/transmitted by signal R1 by wireless device 40 can be received by the communications network and transmitted on the Internet I to a computer 44. The computer 44, may be associated with the manufacturer of the winch 12 or other interested party. The computer 44 and/or the wireless device 40 or controller 14, may store operational data obtained from the sensors S1, S2, S3 and/or commands issued by the User U, either through the wireless device 40 or the other controllers 26, 28 over time. This data may be analyzed to ascertain winch 12 condition via diagnostic software or stored to log a record of winch use, or used to generate advisory information/messages to the user U through signal T2 to the wireless device 40.

Figure 2:
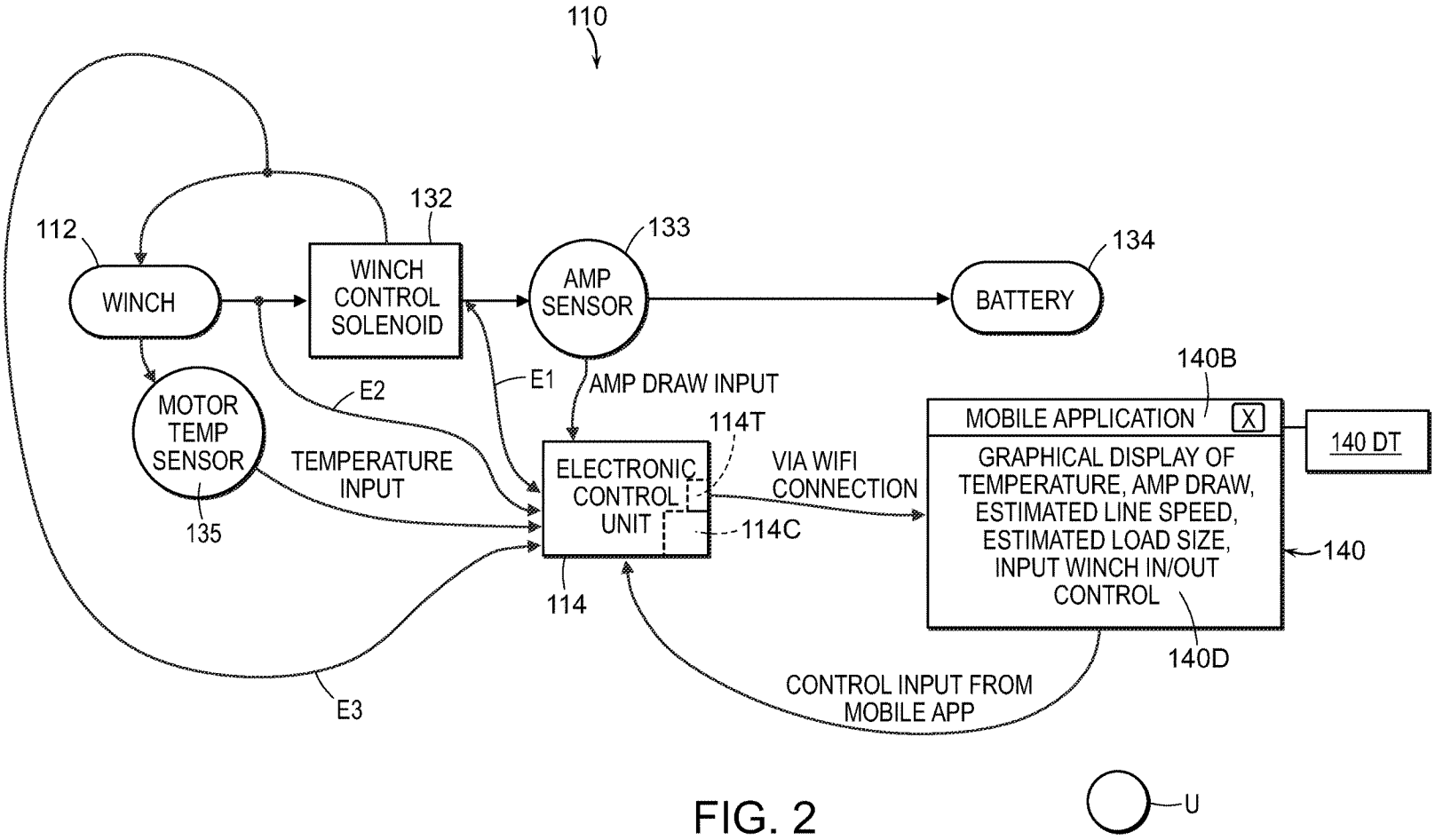
FIG. 2 is a schematic view of a winch and monitoring system in accordance with another embodiment of the present disclosure.

FIG. 2 shows a winch system 110, wherein a current sensor 133 is interposed between a battery 134 and a winch control solenoid 132. The data sensed by the current sensor 133, i.e., the "AMP draw Input" is transmitted to an electronic control unit 114, e.g., by a wire or by a wireless signal. A motor temperature sensor 135 senses the temperature of the winch 112 motor and transmits that information to the control unit 114. The electronic control unit 114 uses a transceiver 114T to transmit the data pertaining to Amp draw and motor temperature over a WiFi connection to the wireless unit 140, e.g., a cell phone. The wireless unit 140 is programmed with a mobile application, e.g., a native smartphone application, which presents the data on amp draw and motor temperature as a graphical display 140D that may be viewed by user U, alerting the user U of winch 112 condition. The data may be simply displayed or analyzed, e.g., relative to data stored in a database 140DT of parameters specific to the electric winch 112 being monitored. Based on the sensed and optionally on the stored data 140DT, the graphical interface 140D alerts the user U of the data. The graphical interface 140D may utilize color-coded graphics to aid the user U in readily appreciating winch 114 condition. In one aspect of the present disclosure, the function of the wireless unit 140 may be invoked on the unit itself 140, e.g., by selecting the app on the unit 140. In another alternative, the wireless functionality can be enabled/disabled by communications with the electronic control unit 114 via a dashboard or winch-mounted switch (not shown). In another alternative, the wireless functionality, when disabled, allows the winch to be operated in accordance with a traditional dash mounted, winch mounted or hand-held, wired remote controller with switches that activate the solenoid contactors 132 of the winch 112. In another alternative, the winch 112 may be operated by the non-wireless controllers when the wireless unit 140 is also operational, thereby allowing overlapping/joint control. In one alternative, the wireless and wired units may be selectively prioritized in their control function.

Amp Draw

Current or amp draw can provide various insights into winch operation resulting in improved procedures. The electric motor 16 (FIG. 1) of a winch 12, 112 consumes large amounts of power and therefore has a large impact on the charge level of the battery 34, 134. Without an appreciation of current draw attributable to winch operation, users may inadvertently drain their battery 34, 134 of power, resulting in a vehicle that won't start after winching. Amp draw also provides insights into winch operation. The amp draw from the electric winch motor 16 directly indicates how hard the motor 16 is working. Knowing how hard the motor 16 is working can translate into preserving the motor from damage, while providing greater confidence in working the motor up to its full capacity. In addition, amperage draw can be interpreted in light of other data to gain additional insights into winch operation. For example, operating parameters such as line speed and approximate load, may be calculated from amp draw as further explained below and, indicate to the user what they should be seeing during the winching operation by a particular winch. Any deviation noticed by the operator provides the opportunity to inspect the winching set-up to avoid difficulties.

In addition to the data pertaining to amp draw and motor temperature, the native application 140B could also be cognizant of time, e.g., by referencing clock/calendar data present on the wireless unit 140 or a clock 114C on the electronic controller 114. In one embodiment, the sensor data sent over the WiFi connection may be marked with the time that it was received from the sensors, e.g., motor temperature sensor 135 and current sensor 133. Alternatively, sensor data can be time stamped upon receipt by the wireless device 140. This time information may be used to identify the start, stop and run time of the winch 112. From this information, the application 140B (using spool diameter values, gear ratio, and motor speed under various loading conditions) may calculate approximate winch line speed, and/or the approximate load L on the winch 112. This information can then be communicated to the user U via the display 140D.

Winch Line Speed

Knowing the winch line speed may be beneficial in that the user can compare the calculated "best case" line speed for pulling a given load (e.g., a vehicle of a given weight rolling on a surface with a given angle relative to the horizontal) vs. a real world result. The application 140B may query the user U for background information, e.g., vehicle weight, incline, etc. and then calculate an anticipated line speed for a given winch, based upon test data for the particular winch model under various loads. If there is an appreciable difference between the calculated (theoretical) line speed and the actual line speed, as determined by estimating it based upon the sensor data, then the user U may be alerted to this disconnect, which may be attributable to conditions that the user may remedy, e.g., release the handbrake of a vehicle V that is being pulled by the winch 112. Line speed is derived from three data points, viz., the elapsed time of the winching operation, amperage draw, and an empirical curve in database 140DT correlating elapsed time and amperage draw to line speed.

Winch Load

An embodiment of the present disclosure may calculate and graphically display approximate winch load to the user U. As with line speed, the application 140B may query the user U for winching information concerning the load, the angle of surface over which the load is pulled, etc. and then calculate an anticipated load for these circumstances. If there is an appreciable difference between the calculated (theoretical) load and the actual load, as determined by estimating it based upon the sensor data, then the user U may be alerted to this disconnect, which may be attributable to conditions that the user may remedy, e.g., release the handbrake of a vehicle V that is being pulled by the winch 112. In another example, if the system 100 alerts the user that the winch 112 is sensing a load comparable to a 10,000 lb. load, but is only pulling a 1,000 lb. load, application 140B can display a message to stop the winching operation and urge the user U to inspect the set-up to find what is causing the increased comparable load, e.g., a rock in the path of the load, preventing a winch pull which could permanently damage the winch 112. In calculating the approximate load, data pertaining to empirical testing of the specific model of winch 112, which correlates load and amperage (current) draw may be stored in database 140DT and referred to in application 140B to determine the actual load experienced by the winch 112.

Solenoid Life

Many electric winches rely on contactor solenoids 132 for controlling motor direction, i.e., depending on how they are energized from a controller. Without proper solenoid functionality, the electric winch 112 will not operate. In accordance with another embodiment of the present disclosure, FIG. 2 shows electrical leads E1, E2, E3 that connect the control unit 114 circuit board to the inputs and outputs of the contactor solenoid 132. Firmware on the circuit board of the control unit 114 may compare the voltages on E1, E2, E3 to anticipated values and report the condition to the mobile application 140B on wireless device 140. The mobile application 140B can then use this data to approximate solenoid life. Of the many wear parts in a winch 112, the solenoid 132 is the most likely to fail. The solenoid handles current switching, allowing the winch to operate in Winch-IN, Winch-OUT and STOP. Over time, copper contact pads in the solenoid become worn due to arcing when going into and out of contact. An aspect of the present disclosure is an apparatus and method of gaining insight into the state of the solenoid. More particularly, by measuring voltage drop the across the solenoid 132 when in the energized or ON position (the voltage drop from the battery 134 voltage to that after the solenoid 132) one can assess the resistance of the solenoid contacts. Given a high resistance indicative of contact wear, the application 140B can alert the user of the solenoid deterioration and/or project an estimated remaining useful life of the solenoid 132. A simple wire connecting to a PCB board in the electronic control unit 114 will allow controller 114 to transmit the voltage to the mobile unit 140 where the application 140B can interpret the voltage as indicating a state or condition of the solenoid 132 (contacts) and display an appropriate message to the user U to assess the user U of the present state of the solenoid 132. This allows a user U to surmise solenoid condition at any time, e.g., over the life of the winch/solenoid, or before or during a winching session and could prevent a winch failure before it occurs.

Figure 3:
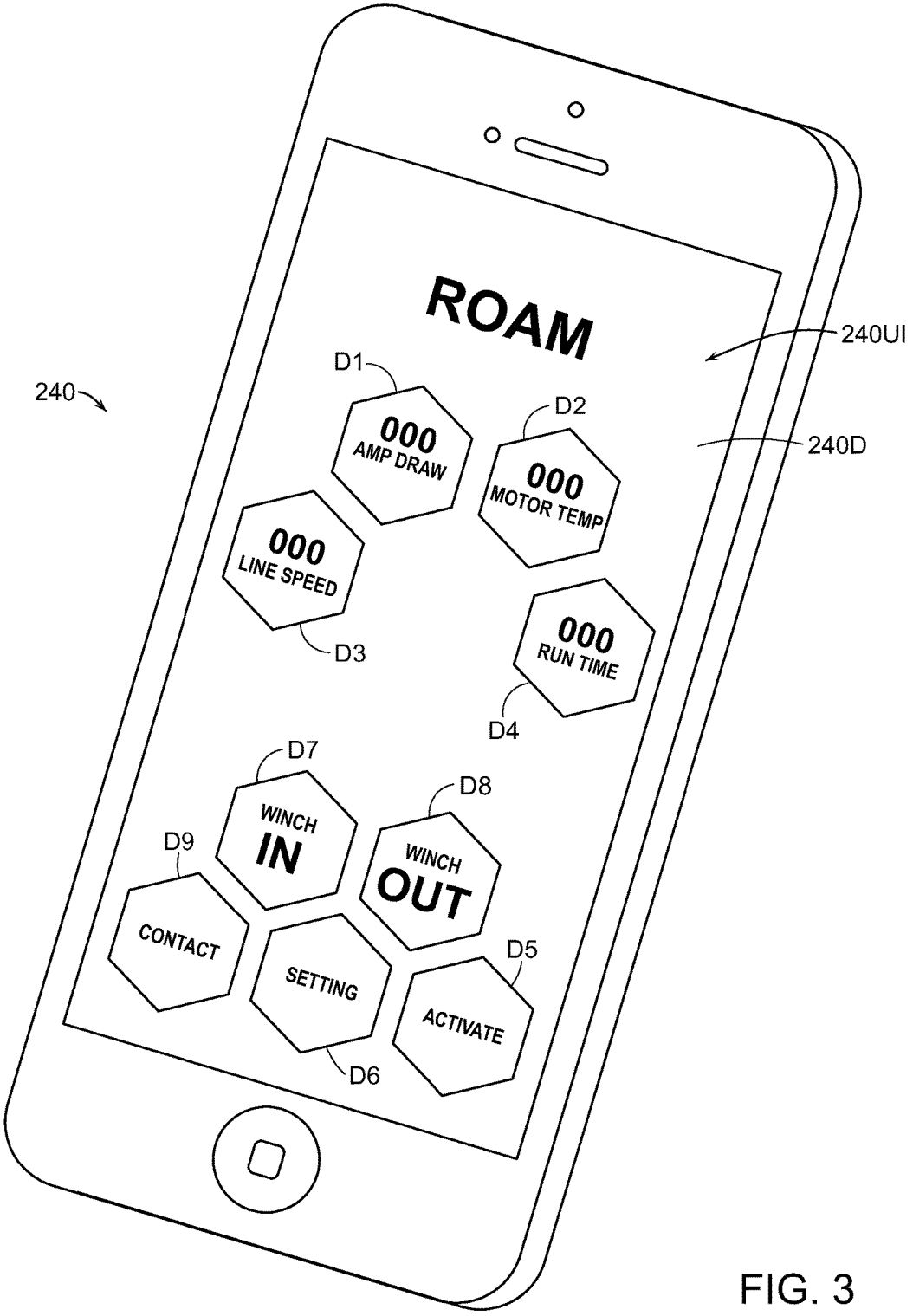
FIG. 3 is a perspective view of a wireless device displaying a user interface in accordance with an embodiment of the present disclosure.

FIG. 3 shows a wireless device 240 in accordance with an embodiment of the present disclosure with a native app installed for displaying the data sensed and reported, as described above. A "Main" page displays the graphical output in a clear and easy to read manner, e.g., in display areas D1-D4: D1 (AMP DRAW), D2 (MOTOR TEMP), D3 (LINE SPEED), D4 (RUN TIME) allowing user U to get a quick understanding of winch conditions at a glance. As the winch 12, 112 operates, the sensor data captured, reported and presented is refreshed periodically, e.g., once per second, providing accurate, actionable information. As the data moves into predetermined zones (or ranges), colors may be used to indicate this change in status to make it more noticeable to a user U. For example, if motor temperature reaches a point that may compromise motor function or place the motor in jeopardy of burn-out, the graphical data displayed at D2 could be displayed in red to emphasize this fact. The data displayed in areas D1-D4 provide insight into winch condition and operation as the winch 12, 112 is used and may cause the user U to interactively adjust their operational commands. The operational commands and other controls may be displayed in separate areas D5-D9 on the same display 240D. To initiate operation of the wireless device 240 as a recipient of data and as a command and control unit, the ACTIVATE button D5 may be selected. This may be a virtual "button" displayed on a touch screen. Once activated, the buttons D7 and D8 may be selectively activated to control winch IN and Winch OUT operation. Depression of these buttons sends a wireless (radio) signal to the controller 14, 114, which then activates the solenoid contactors supplying the winch motor with electrical power from the battery in the proper polarity to induce rotation in the selected direction.

A button D6 may be activated to access and set various settings of the application (140B), e.g., to allow users to select a particular brand and model of electric winch with associated predetermined data points, as well as networking connection information. A button D9 may be selected to invoke a telephone call, an email, live chat or connect to a given website on the Internet. This communication can then be used to send and receive information concerning the winch 112, 12 and its condition to another, e.g., a representative of the company that manufactured the winch. The brightness of the screens used by current wireless devices, smartphones, tablets, iPods etc., facilitates communicating with users U in a graphical manner. The graphical display 240D may provide a high level of detail and information in a simple format. A history page may be displayed showing data from the last winching operation by accessing button D10 (See FIG. 12).

Figure 4:
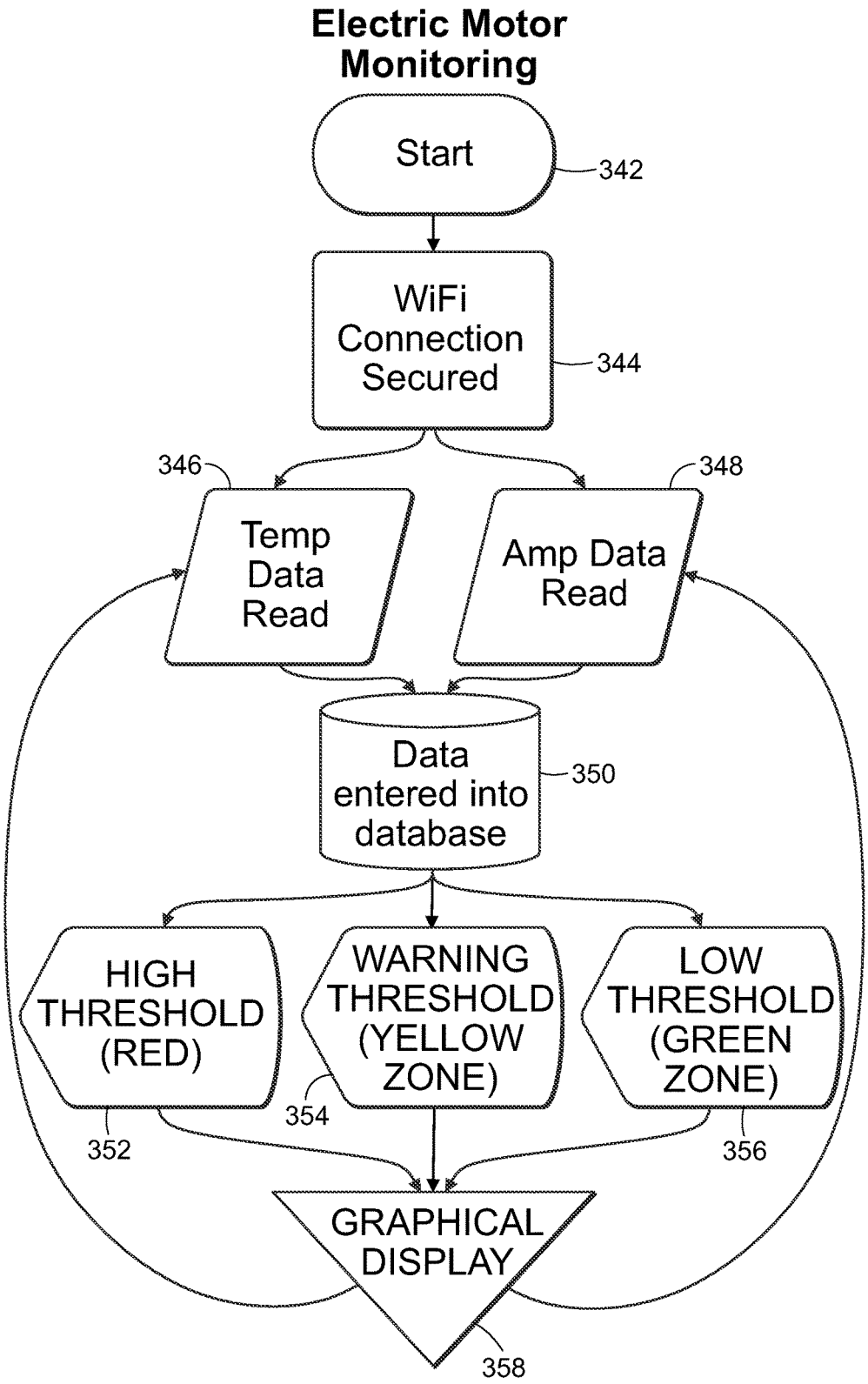
FIG. 4 is a flow diagram of data and processing conducted by a program running on a wireless device in accordance with another embodiment of the present disclosure.

FIG. 4 is a diagram of the processing conducted by a mobile application 340B (program) in accordance with one embodiment of the present application. The application 340B is started 342, e.g., by the user U depressing the Activate button D5 (FIG. 3). A WiFi connection between the wireless device 40, 140 and the controller 14, 114 is established 344. The WiFi communication link (local network) allows the exchange of sensor data between the control 14, 114 and the wireless unit 40, 140, with temperature data being exchanged 346 and current data being exchanged 348. The sensor data from steps 346, 348, as well as operator entered data may be entered into the database 350. The database 140DT may already contain operating parameters pertaining to the specific winch 12, 112 unit, e.g., current/load curves, etc. The data that is in the database is then processed to ascertain a suitable output message to be displayed to the user U, e.g., that a given measured parameter, such as motor temperature falls within one of three ranges, e.g., high 352 with which a RED color display is associated, warning or caution 354 with which a YELLOW color display is associated, or low 356 with which a GREEN color display is associated. The appropriate message, e.g., the motor temperature is then displayed 358 on the display 40D, 140D.

Figure 5:
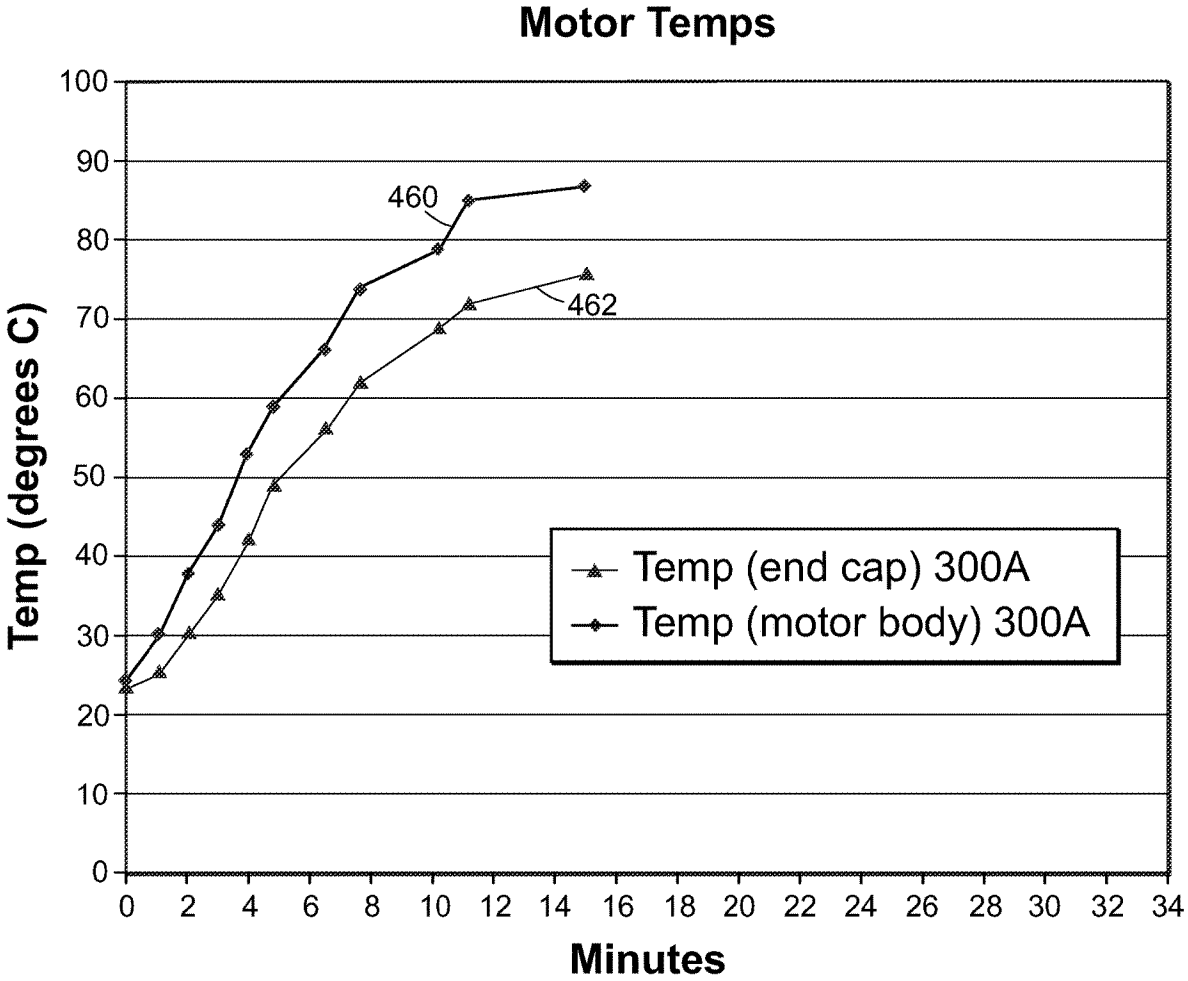
FIG. 5 is a graph of motor temperature over time in accordance with an embodiment of the present disclosure.

FIG. 5 shows two line graphs, 460, 462 connecting data points for temperature of a motor body and a motor end cap, respectively, over time. The time may represent run time for a single continuous operation of a winch motor or multiple ON/OFF cycles of a winch motor over a given time period. In the event that the rate of motor heating exceeds motor cooling, the longer the motor runs, the greater the temperature.

Figure 6:
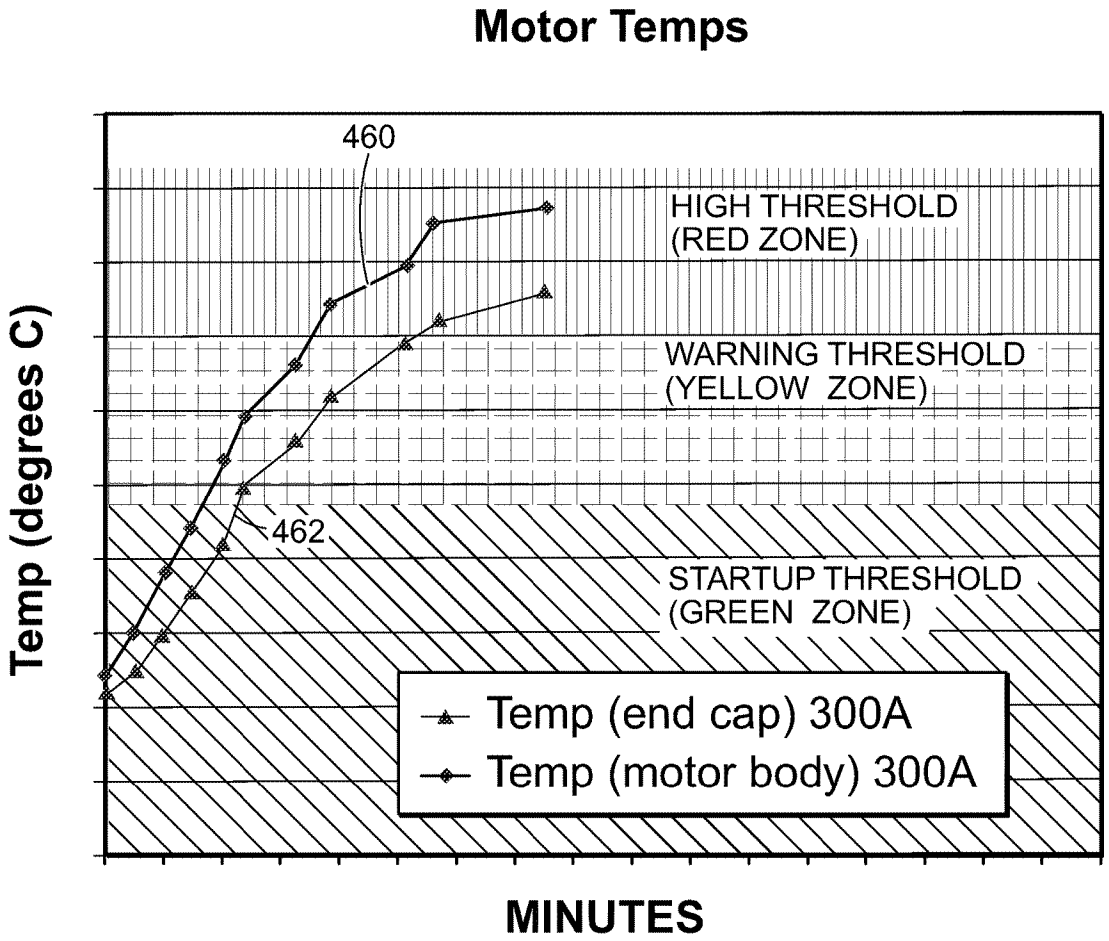
FIG. 6 is a graph like FIG. 5 showing ranges of temperature associated with different levels of concern in accordance with an embodiment of the present disclosure.

FIG. 6 shows similar line graphs 460, 462 as FIG. 5, but showing assigned ranges of concern with respect to motor temperature. The motor temperature data obtained by a sensor, e.g., S2, can be categorized in one of these ranges by program logic, e.g., conditional statements or rules that can classify a given temperature into one of the levels (RED, YELLOW, GREEN), which can then drive the messaging color to the user U via the display 40D, 140D. Color coding of data output provides an unambiguous warning to the user U of operation in a range below normal, normal, or elevated. This categorization may be based on empirical knowledge and may be specific to each electric motor by winch model. A database 140D developed through testing may contain data points for any given number of electrically motorized winch products. Empirical knowledge may be used to assess the thresholds of the ranges to identify when measured parameters, such as amperage, temperature, line speed, and solenoid millivolt drop are below, at, or above normal levels.

In accordance with an aspect of the present disclosure, testing may be conducted by winch manufacturers or others to ascertain a power curve for each electric motor used in that company's winch products, or for electric motors used in other companies' winches. This testing may be conducted by load testing using simulated battery input, resulting in a power curve that accurately depicts the electric motor's efficiency for a given load. The testing regimen may also include identifying the normal/operational range of sensor inputs during winch operation, as well as identifying where the elevated range of sensor readings begins. This may be done for each individual winch.

Winching operations can be conducted in high-stress environments and require thoughtful operation, since the forces involved can be substantial and winch users must be alert to multiple circumstances while winching. The winch system 10 of the present disclosure provides an easily understood user interface that allows important winch condition data to be appreciated at a glance and in a variety of physical positions relative to the winch. The apparatus and method of the present disclosure utilizes normalized data points that are scanned periodically, e.g., several times a second via sensors, e.g., in the motor 16 and the battery 34 leads.

The winch system 10, 110 provides both monitoring and controlling functions, which may be integrated on a single device, e.g., wireless device 40, 140 to inform the user U of winch condition in a non-intrusive way and without distracting the user's attention from the external conditions of winching, such as the movement of the load L, the connection of the cable 20 to the load L, etc. Monitoring the operating condition of the winch may improve winching operation as well as preserving the winch from being overstressed.

Figure 7:
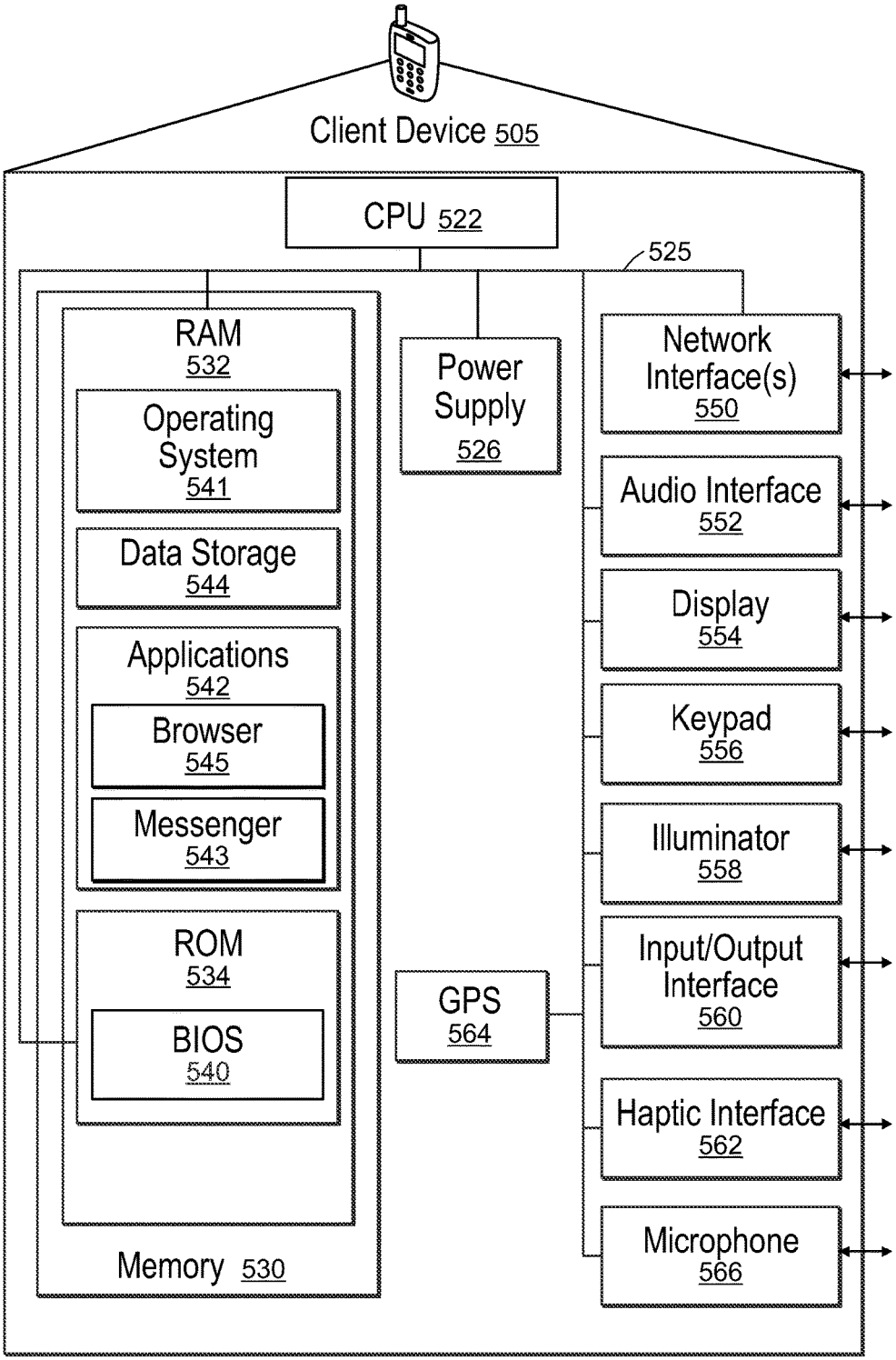
FIG. 7 is a schematic diagram of a wireless client device in accordance with one exemplary embodiment of the present disclosure.

FIG. 7 shows one example of a schematic diagram illustrating a client device 505 that can function as wireless device 40, 140, 240. Client device 505 may include a computing device capable of sending or receiving signals, such as via a wired or wireless network. A client device 505 may, for example, include a dash or under-dash mounted computer or a portable device, such as a cellular telephone, a smartphone, a display pager, a radio frequency (RF) device, an infrared (IR) device, a Personal Digital Assistant (PDA), a handheld computer, a tablet computer, a laptop computer, a digital camera, a set top box, a wearable computer, an integrated device combining various features, such as features of the foregoing devices, or the like.

The client device 505 may vary in terms of capabilities or features. Claimed subject matter is intended to cover a wide range of potential variations. For example, a cell phone may include a numeric keypad or a display of limited functionality, such as a monochrome liquid crystal display (LCD) for displaying text, pictures, etc. In contrast, however, as another example, a web-enabled client device may include one or more physical or virtual keyboards, mass storage, one or more accelerometers, one or more gyroscopes, global positioning system (GPS) or other location-identifying type capability, of a display with a high degree of functionality, such as a touch-sensitive color 2D or 3D display, for example.

A client device 505 may include or may execute a variety of operating systems, including a personal computer operating system, such as a Windows, iOS or Linux, or a mobile operating system, such as iOS, Android, or Windows Mobile, or the like. A client device may include or may execute a variety of possible applications, such as a client software application enabling communication with other devices, such as communicating one or more messages, such as via email, short message service (SMS), or multimedia message service (MMS), including via a network, such as a social network, including, for example, Facebook®, LinkedIn®, Twitter®, Flickr®, or Google+®, to provide only a few possible examples. A client device may also include or execute an application to communicate content, such as, for example, textual content, multimedia content, or the like. A client device may also include or execute an application to perform a variety of possible tasks, such as browsing, searching, playing various forms of content, including locally stored or streamed video, or games. The foregoing is provided to illustrate that claimed subject matter is intended to include a wide range of possible features or capabilities.

As shown in the example of FIG. 7, client device 505 may include one or more processing units (also referred to herein as CPUs) 522, which interface with at least one computer bus 525. A memory 530 can be persistent storage and interfaces with the computer bus 525. The memory 530 includes RAM 532 and ROM 534. ROM 534 includes a BIOS 540. Memory 530 interfaces with computer bus 525 so as to provide information stored in memory 530 to CPU 522 during execution of software programs such as an operating system 541, application programs 542, device drivers, and software modules 543, 545 that comprise program code, and/or computer-executable process steps, incorporating functionality described herein, e.g., one or more of process flows described herein. CPU 522 first loads computer-executable process steps from storage, e.g., memory 532, data storage medium/media 544, removable media drive, and/or other storage device. CPU 522 can then execute the stored process steps in order to execute the loaded computer-executable process steps. Stored data, e.g., data stored by a storage device, can be accessed by CPU 522 during the execution of computer-executable process steps.

Persistent storage medium/media 544 is a computer readable storage medium(s) that can be used to store software and data, e.g., an operating system and one or more application programs. Persistent storage medium/media 544 can also be used to store device drivers, such as one or more of a digital camera driver, monitor driver, printer driver, scanner driver, or other device drivers, web pages, content files, playlists and other files. Persistent storage medium/media 506 can further include program modules and data files used to implement one or more embodiments of the present disclosure.

For the purposes of this disclosure a computer readable medium stores computer data, which data can include computer program code that is executable by a computer, in machine readable form. By way of example, and not limitation, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data.

Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

Client device 505 can also include one or more of a power supply 526, network interface 550, audio interface 552, a display 554 (e.g., a monitor or screen), keypad 556, illuminator 558, I/O interface 560, a haptic interface 562, a GPS 564, and/or a microphone 566.

For the purposes of this disclosure a module is a software, hardware, or firmware (or combinations thereof) system, process or functionality, or component thereof, that performs or facilitates the processes, features, and/or functions described herein (with or without human interaction or augmentation). A module can include sub-modules. Software components of a module may be stored on a computer readable medium. Modules may be integral to one or more servers, or be loaded and executed by one or more servers. One or more modules may be grouped into an engine or an application.

Figure 8:
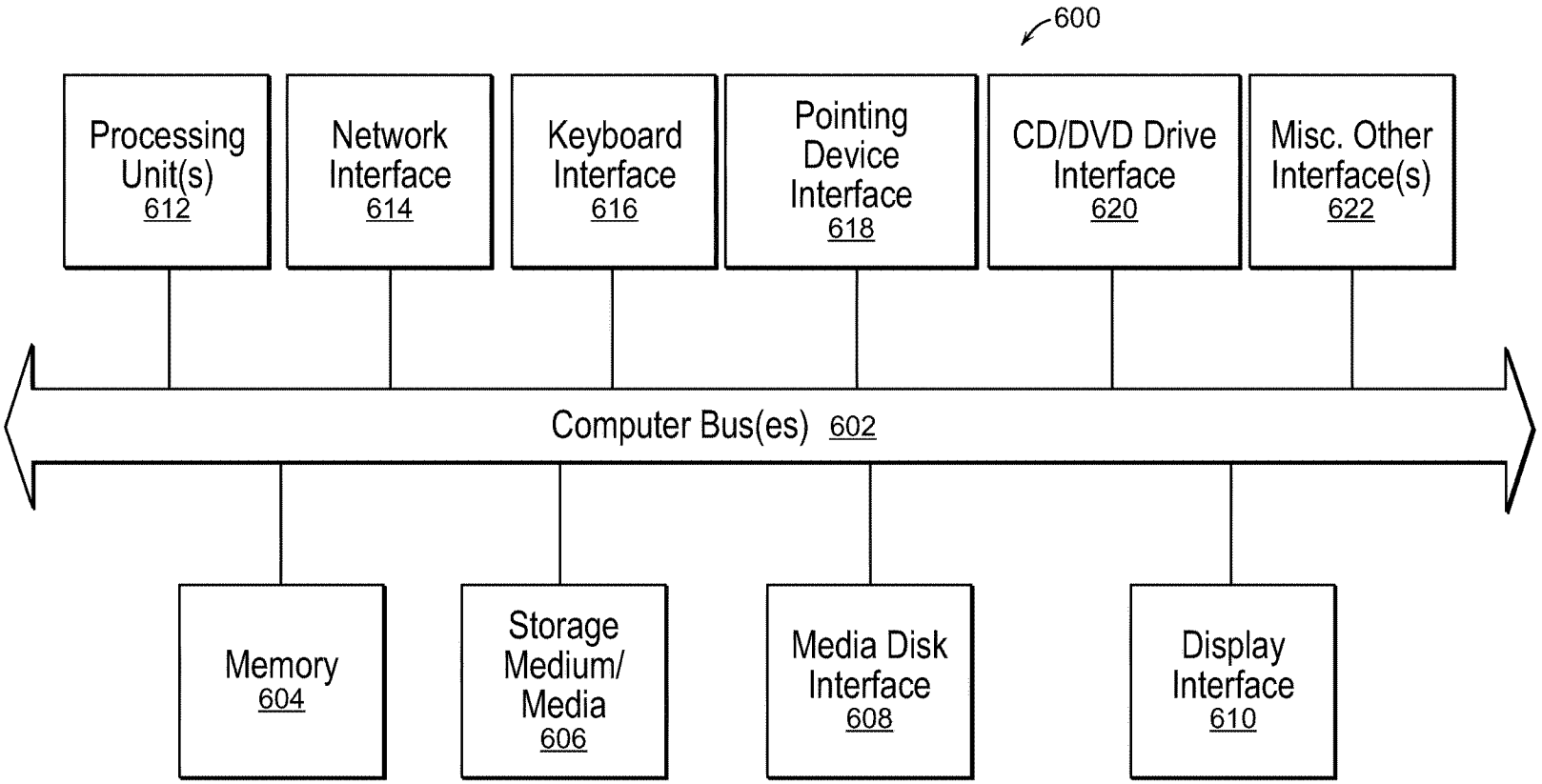
FIG. 8 is a schematic diagram illustrating a computer architecture in accordance with one exemplary embodiment of the present disclosure.

FIG. 8 is a block diagram illustrating an internal architecture of an example of a computer, such as server computer 44, cabin-mounted controller 28, controller 14 and/or client device 40, 140, 240, in accordance with one or more embodiments of the present disclosure. A computer as referred to herein refers to any device with a processor capable of executing logic or coded instructions, and could be a server, personal computer, set top box, tablet, smart phone, pad computer or media device, to name a few such devices. As shown in the example of FIG. 8, internal architecture 600 includes one or more processing units (also referred to herein as CPUs) 612, which interface with at least one computer bus 602. Also interfacing with computer bus 602 are persistent storage medium/media 606, network interface 614, memory 604, e.g., random access memory (RAM), run-time transient memory, read only memory (ROM), etc., media disk drive interface 608 as an interface for a drive that can read and/or write to media including removable media such as floppy, CD-ROM, DVD, etc. media, display interface 610 as interface for a monitor or other display device, keyboard interface 616 as interface for a keyboard, pointing device interface 618 as an interface for a mouse or other pointing device, CD/DVD drive interface 620, and miscellaneous other interfaces 622, such as parallel and serial port interfaces, a universal serial bus (USB) interface, and the like.

Memory 604 interfaces with computer bus 602 so as to provide information stored in memory 604 to CPU 612 during execution of software programs such as an operating system, application programs, device drivers, and software modules that comprise program code, and/or computer-executable process steps, incorporating functionality described herein, e.g., one or more of process flows described herein. CPU 612 first loads computer-executable process steps from storage, e.g., memory 604, storage medium/media 606, removable media drive, and/or other storage device. CPU 612 can then execute the stored process steps in order to execute the loaded computer-executable process steps. Stored data, e.g., data stored by a storage device, can be accessed by CPU 612 during the execution of computer-executable process steps.

As described above, persistent storage medium/media 606 is a computer readable storage medium(s) that can be used to store software and data, e.g., an operating system and one or more application programs. Persistent storage medium/media 606 can also be used to store device drivers, such as one or more of a digital camera driver, monitor driver, printer driver, scanner driver, or other device drivers, web pages, content files, playlists and other files. Persistent storage medium/media 606 can further include program modules and data files used to implement one or more embodiments of the present disclosure.

Algorithms

For calculating Winch Speed and Winch Load from the sensor data of Amperage, the algorithms described below in reference to FIG. 9 and FIG. 10 may be used. Those trained in the field can recognize that other algorithms could be used in accordance with the teachings of the present disclosure, and these other algorithms should also be considered to fall within the scope of the present disclosure and claims. Other algorithms could be based on amperage, such as relating winch Amperage to temperature, motor life, number of line wraps on drum, type of vehicle being pulled, type of surrounding terrain, solenoid condition) or algorithms based on motor temperature, solenoid condition, drum revolution speed, motor revolution speed, line speed, gear speed, drive shaft speed, or other external speed indicating device. Essentially, any known data point (as described above) could be extrapolated to important winching data points.

Figure 9:
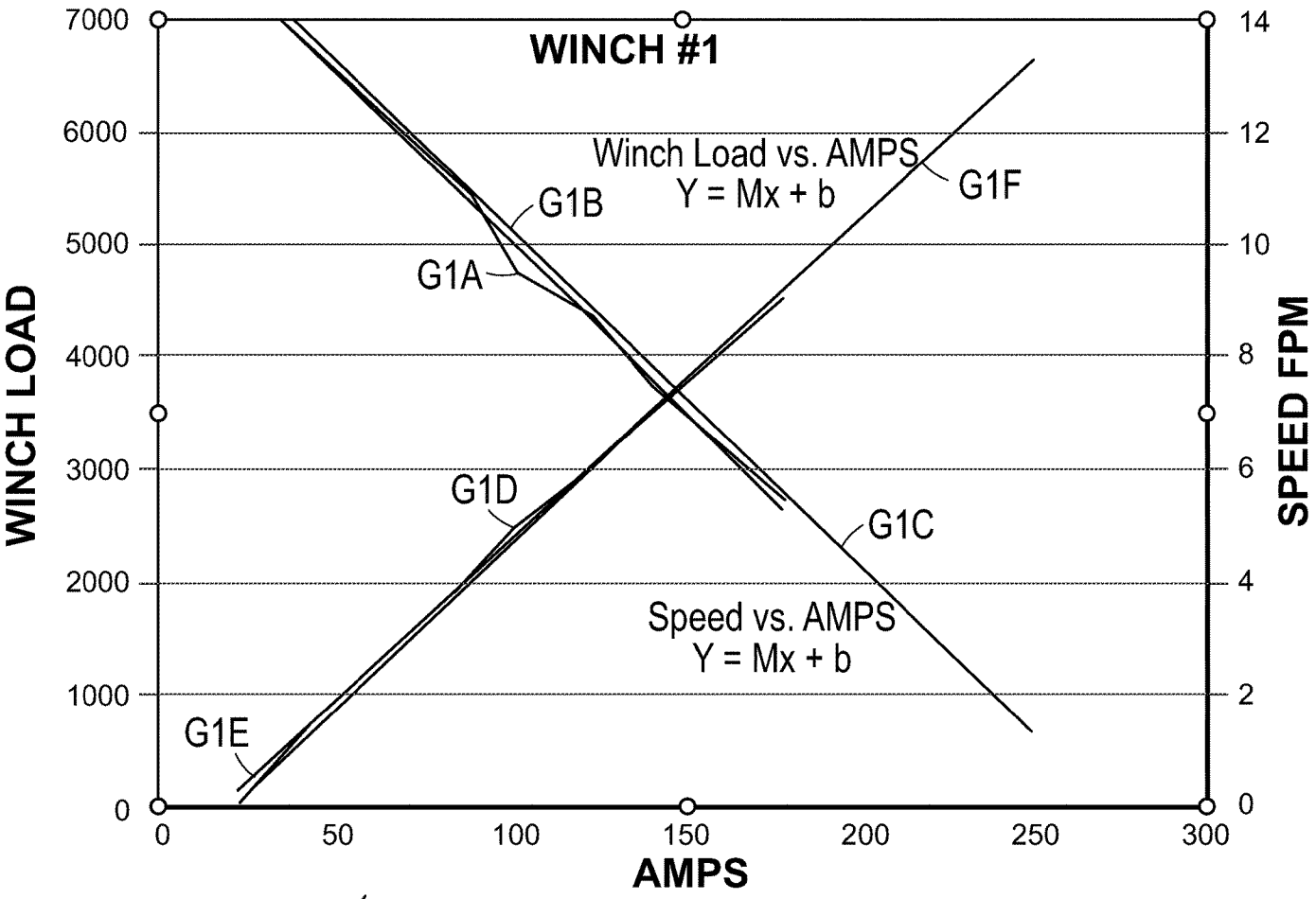
FIG. 9 and FIG. 10 are graphs of winch load and winch speed vs. electrical current draw in accordance with an embodiment of the present disclosure.

FIG. 9 is a graph G1 of winch load and winch speed vs. electrical current draw in accordance with an embodiment of the present disclosure. For a particular winch model, a representative specimen of that model is tested under load and the amperage draw and winch speed is monitored. The results of the testing is plotted for a range of winch loads and a performance graph is plotted from the multiple data points yielded by the testing. More particularly lines G1A, G1B were generated from empirically testing a winch (Winch #1) under load. Lines G1A and G1B show that as winch load increases, the winch draws more amperage from the vehicle battery and winch speed decreases. An equation may then be derived from the plotted lines, using Microsoft Excel, or other means. Line G1C is a plot of an equation that closes matches the empirical lines G1A, G1B, which may be used to characterize the performance model of the winch tested. This process may be conducted multiple times for each model winch of interest to develop a performance graph (equation/line) that is representative of the performance characteristics of that particular model winch. The same performance data is captured for winch load vs. amperage draw and plotted as empirically derived lines G1D and G1E, from which line G1F and its associated equation may be derived.

For a winch with a permanent magnet motor, the speed decrease and load increase associated with increasing amperage draw are typically linear, as in FIG. 9. Therefore the equation that is used to model the tested winch of FIG. 9 in the algorithm is the simple equation of a straight line Y=Mx+b, where Y is the value calculated, x is a known amperage point, M is the slope of the line, and b is the y-intercept. This is known in Mathematics as the "slope-intercept" form of a straight line equation.

Figure 10:
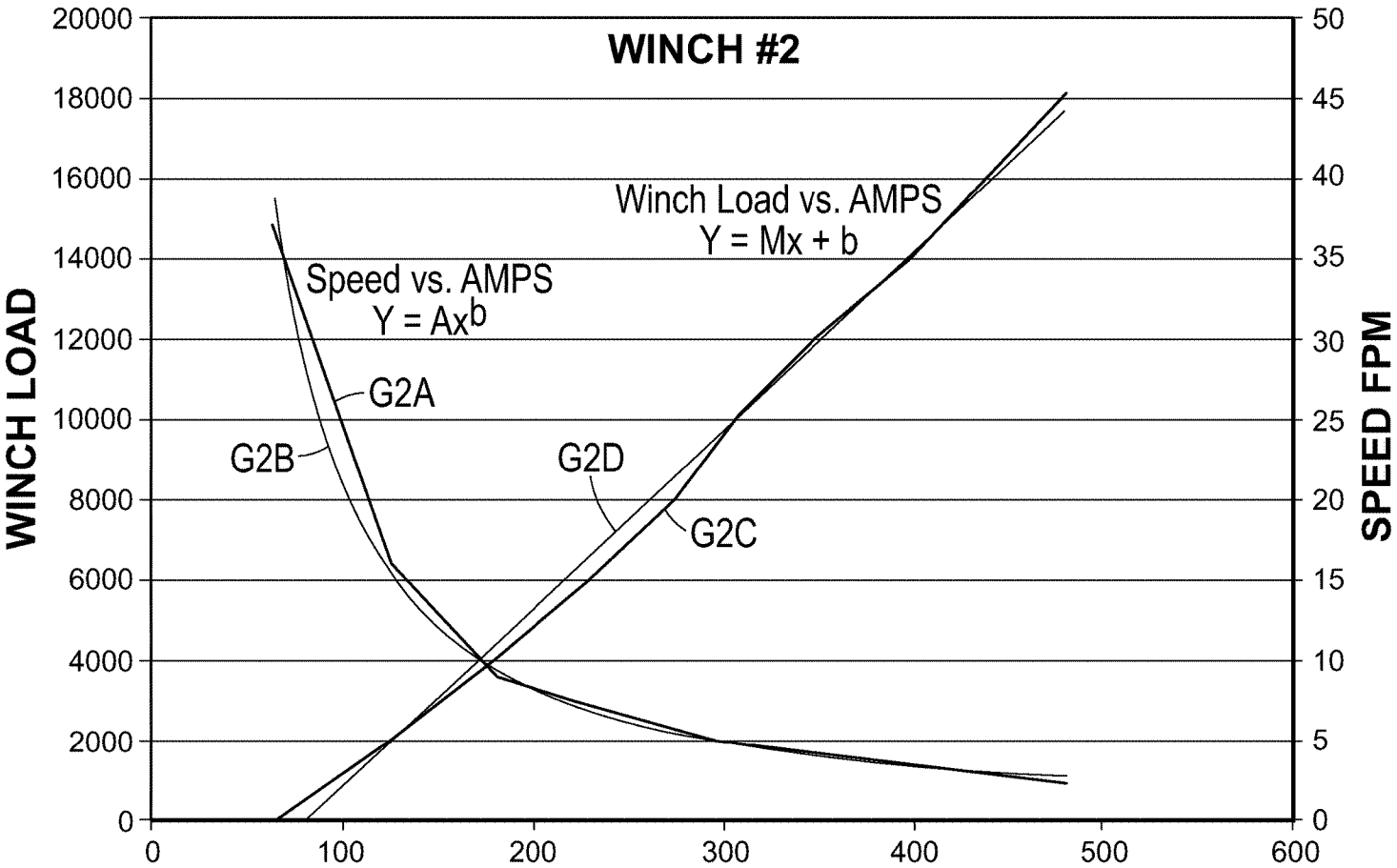

FIG. 10 illustrates a similar process for arriving at a model/equation for a winch with a series-wound motor. The winch performance graph G2 is typically slightly different than graph G1 of FIG. 9, in that the load increase with increasing amperage is still typically linear as shown by empiral line G2C and fitted line G2D. The speed decrease with increasing amperage is typically of the shape of a polynomial curve, as shown by empirical line G2A and fitted line G2B. For this type of winch, a polynomial or exponential function, such as $Y=Ax^b$ or $Y=Ax^2+Bx+C$ or $Y=Ae^x$ is used to most accurately fit the true speed data of the winch.

Figure 11:
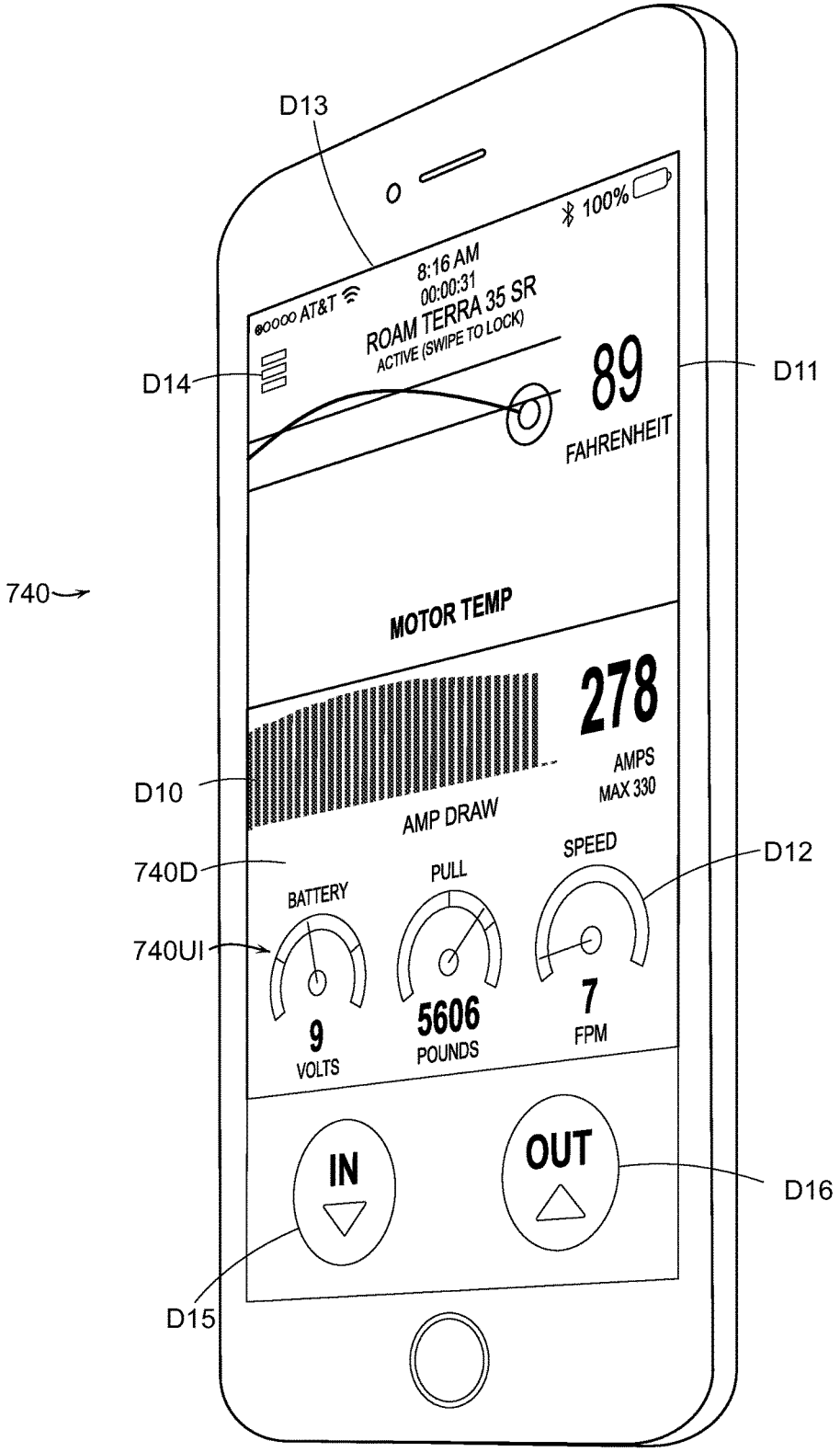
FIG. 11 is a perspective view of a wireless device displaying a user interface in accordance with an embodiment of the present disclosure.
Figure 12:
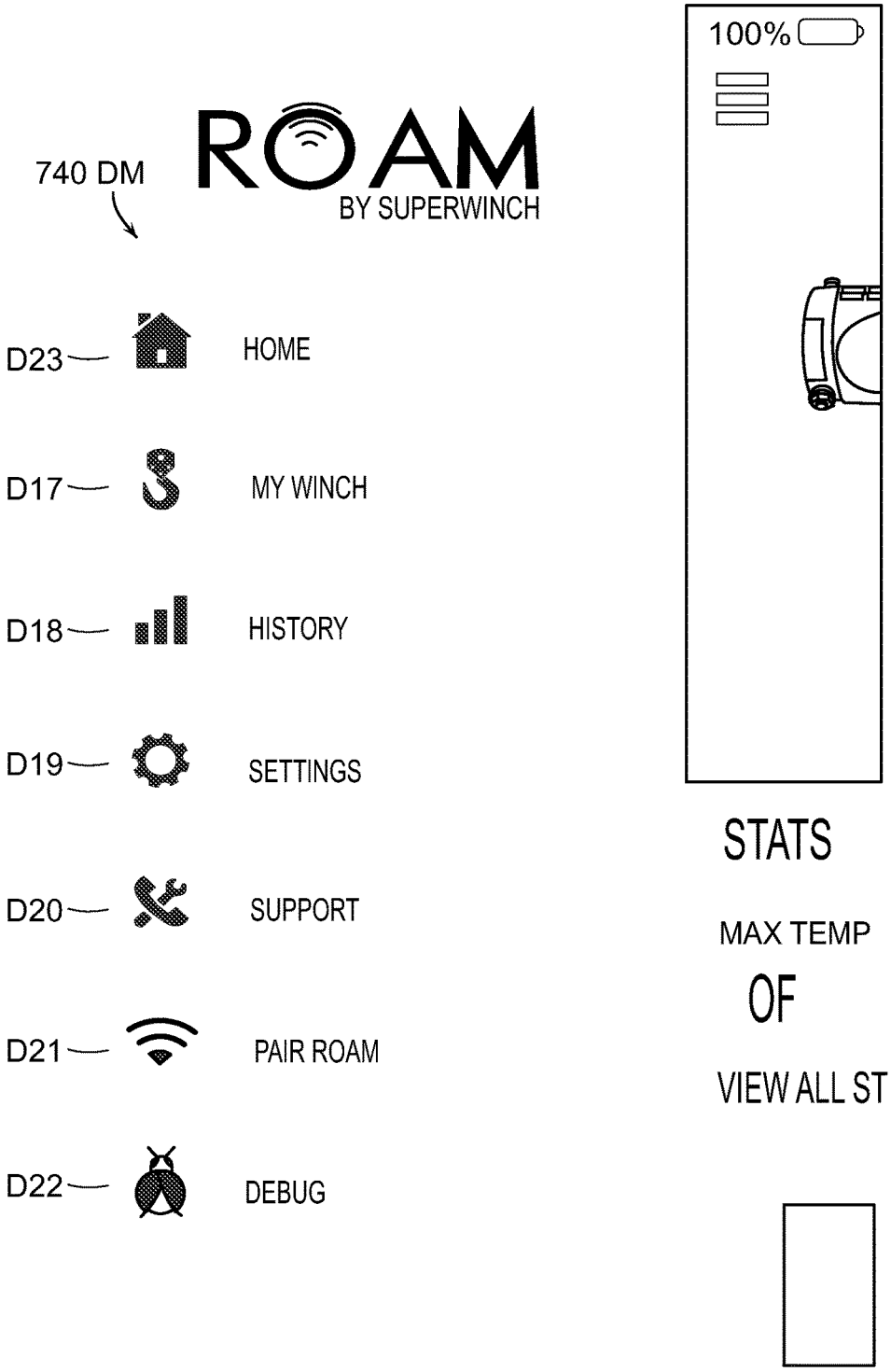
FIG. 12 is a user interface in accordance with an embodiment of the present disclosure.

FIG. 12 shows a menu 740 DM screen of user interface 740UI (FIG. 11) displayable on wireless device 740. Speed and Load equations may be developed for multiple winches, e.g., all models produced by one or more manufactures and the winch model may be selectable by the user U in the application, as shown by button D17 of FIG. 12. The wireless device 40 and or the controller 14 may store all of the performance equations for the winch(es) of interest to the user U.

FIG. 11 shows an alternative graphical user interface 740UI on display 740D of wireless device 740. As in the embodiment of FIG. 3, the operational commands and other controls may be displayed in separate areas D10-D16. The user interface 720UI may be accessible via a menu display 740DM of FIG. 12. To initiate operation of the wireless device 740 as a recipient of data and as a command and control unit, the user would open the specified app available from a public-facing app store, and the PAIR ROAM button D21 may be selected. This may be a virtual "button" displayed on a touch screen. Once paired, the buttons D15 and D16 shown in FIG. 11 may be selectively activated to control winch IN and Winch OUT operation. Further once paired, additional graphical data info can be displayed, such as motor temp, amperage draw, battery voltage, approximate line speed and load. Should network connectivity be lost, the winch is shut down and the user is required to reconnect.

The menu 740DM may be accessed from user interface screen 740UI by touching the "hamburger button" D14 (the three lines in the upper left-hand corner of the smartphone application). The menu 740DM provides user U access to other features. A button D17, may be activated to access and set various settings of the application 140B (FIG. 2), e.g., to allow users to select a particular brand and model of electric winch with associated predetermined data points, as well as networking connection information. A button D20 may be selected to invoke a telephone call, an email, live chat or connect to a given website on the Internet. This communication can then be used to send and receive information concerning the winch 112, 12 and its condition to another, e.g., a representative of the company that manufactured the winch. The brightness of the screens used by current wireless devices, smartphones, tablets, iPods etc., facilitates communicating with users U in a graphical manner. The graphical display 240D may provide a high level of detail and information in a simple format. A history page may be displayed showing data from the last winching operation by touching button D18. Settings, support, debug and return to a home screen may be accessed by touching buttons D19, D20, D22 and D23, respectively.

Figure 13A:
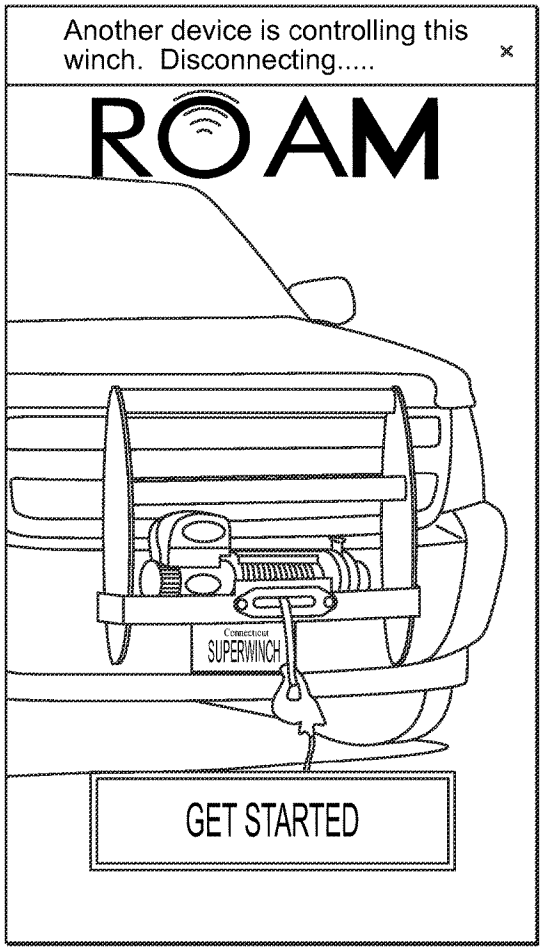
FIGS. 13A-13L are a set of screen shots from a wireless device displaying a user interface in accordance with an embodiment of the present disclosure.
Figure 13B:
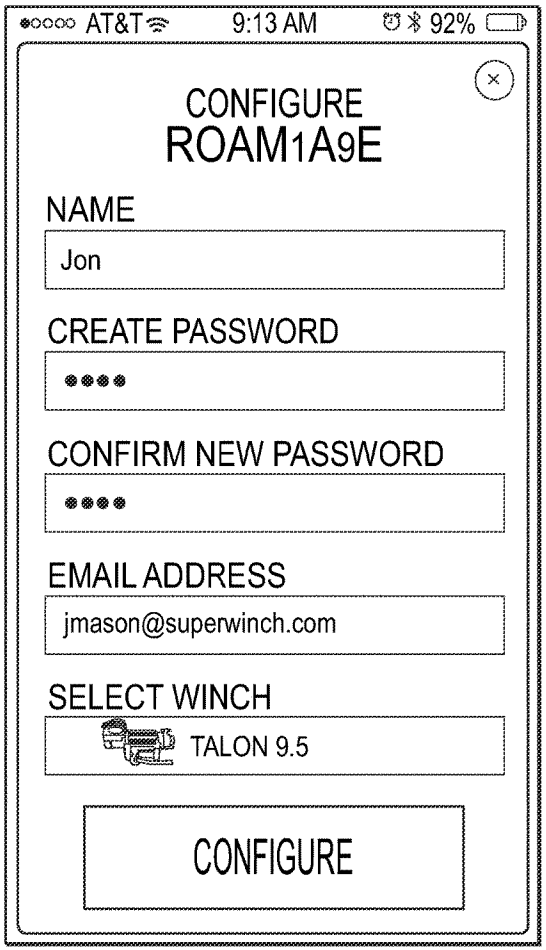
Figure 13D:
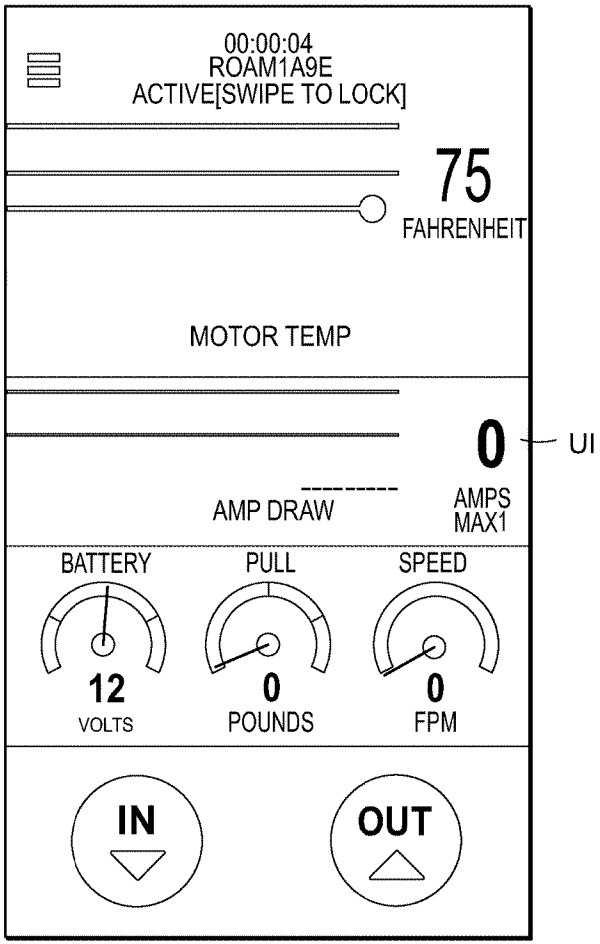
Figure 13C:
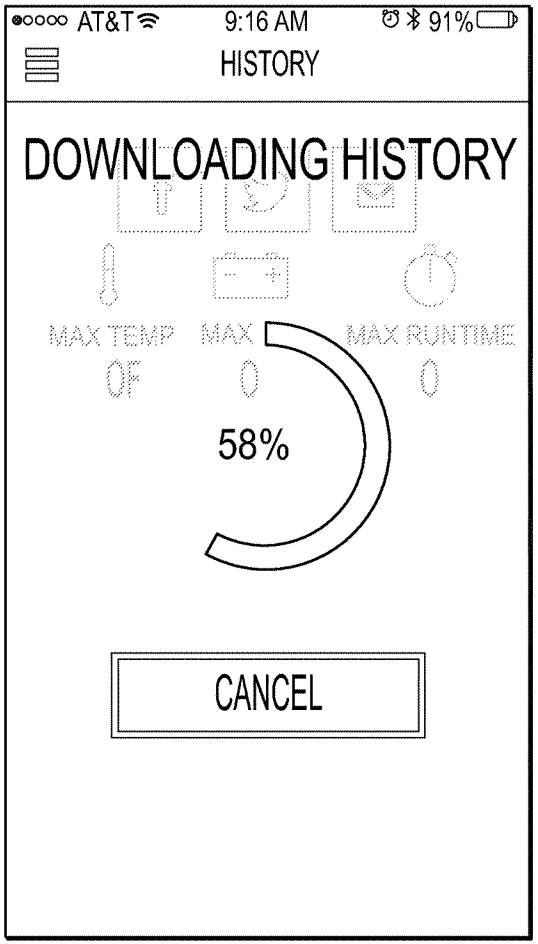
Figure 13E:
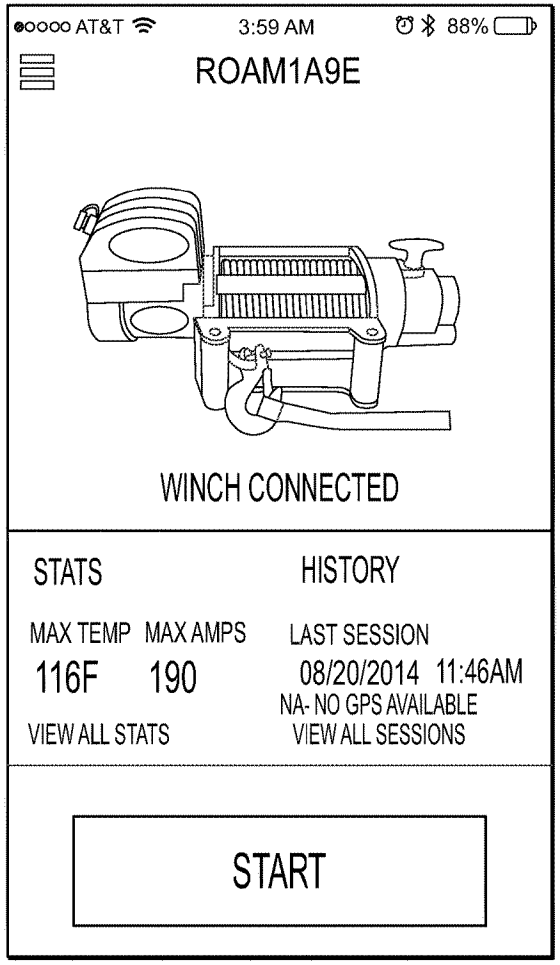
Figure 13F:
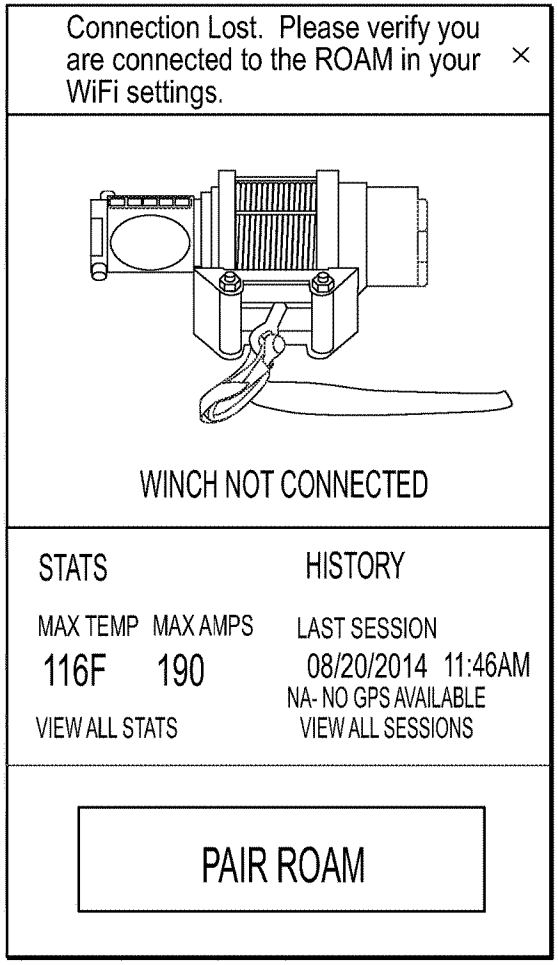
Figure 13H:
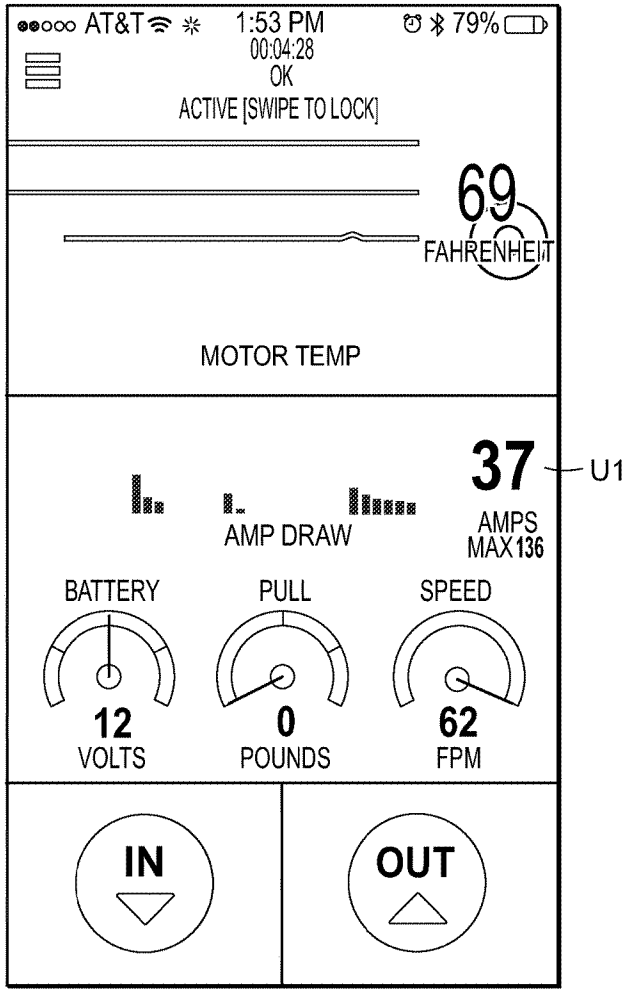
Figure 13G:
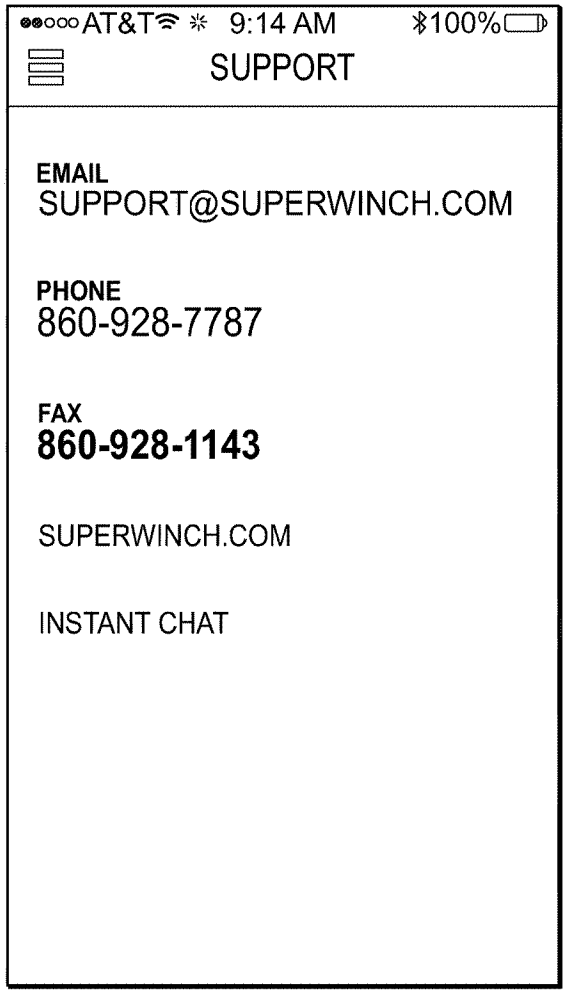
Figure 13J:
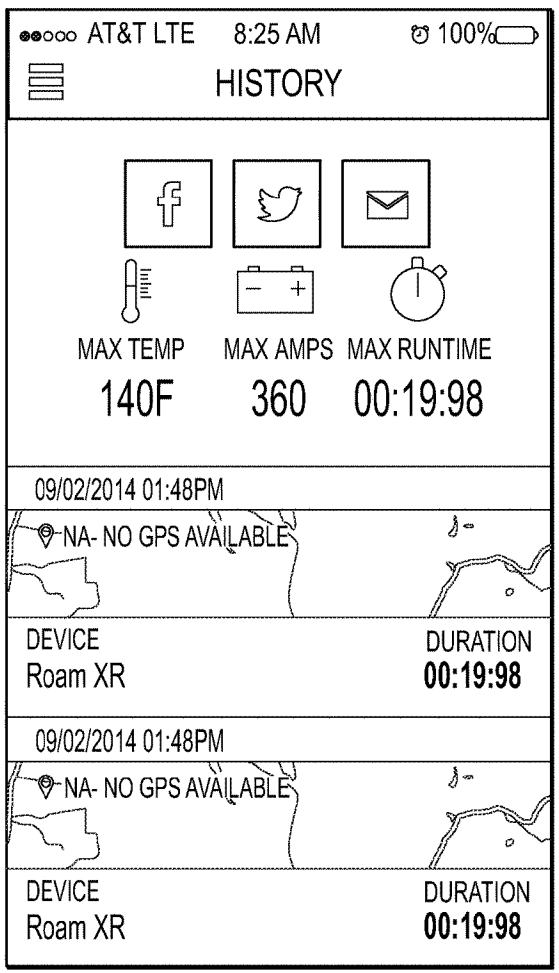
Figure 13I:
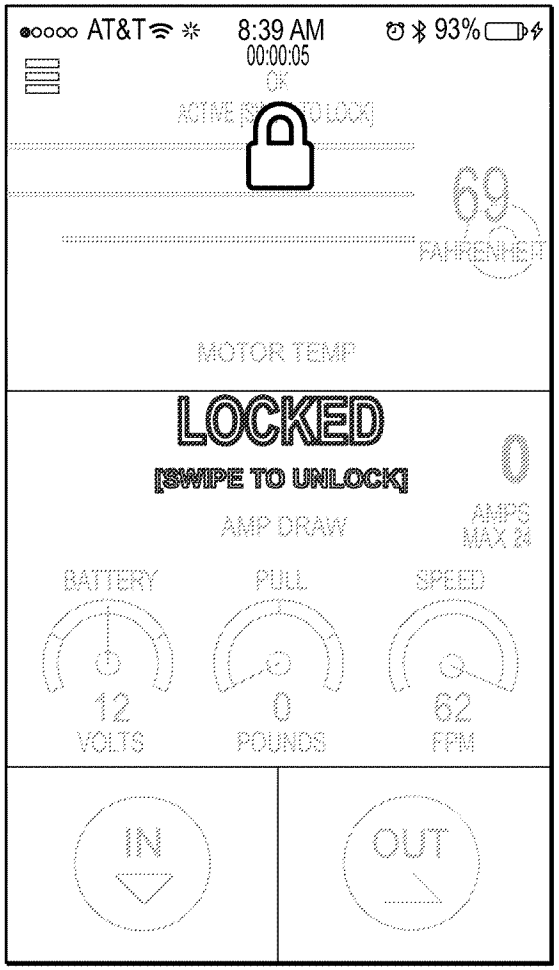
Figure 13L:
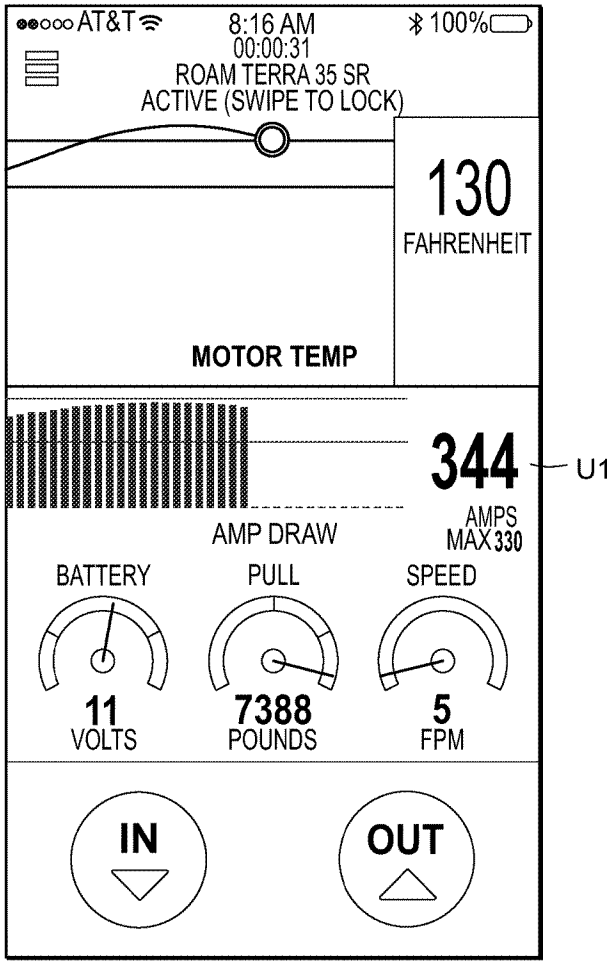
Figure 13K:
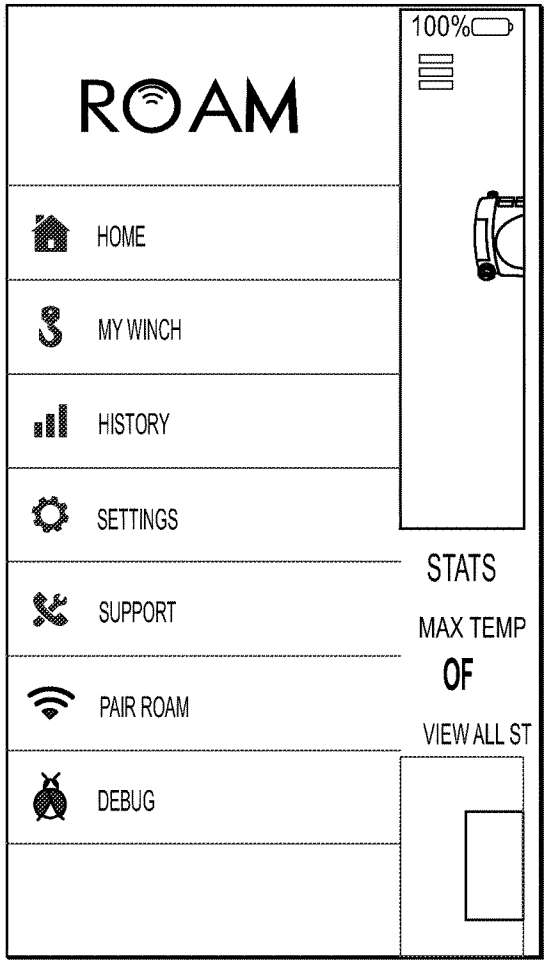

FIGS. 13A-13L show screen shots from a wireless device displaying a user interface in accordance with an embodiment of the present disclosure. FIG. 13A illustrates a condition wherein the wireless device 40 senses that the winch is already being controlled by another device, such as by a handheld, wired remote 26. FIG. 13B illustrates that the wireless controller 40 may be secured to a particular user U by an access code. FIG. 13C illustrates that the wireless device may be programmed to display updates and status to the user U. FIGS. 13D, 13H and 13L illustrate a user interface UI like that shown in FIG. 11 with the battery voltage, load in pounds (pull) and winch speed displayed as dial indicators. Simultaneously, bar graphs may be displayed to show amperage draw and a line graph displays motor temperature. Numerical readouts may also be employed to display a parameter of interest in numerical form.

FIGS. 13E and 13F display winch connection status to the wireless controller 40, as well as values pertaining to limits for the winch of interest. Information on winch prior use is also displayed. FIG. 13G displays information concerning connections to a support center, e.g., offered by the manufacturer. FIG. 131 indicates that the winch controller 40 may be locked, either by the user U or after a given time period to prevent inadvertent usage, e.g., while the wireless controller is stored. FIG. 13J displays detailed prior winch use information.

Those skilled in the art will recognize that the methods and systems of the present disclosure may be implemented in many manners and as such are not to be limited by the foregoing exemplary embodiments and examples. In other words, functional elements being performed by single or multiple components, in various combinations of hardware and software or firmware, and individual functions, may be distributed among software applications at either the user computing device or server or both. In this regard, any number of the features of the different embodiments described herein may be combined into single or multiple embodiments, and alternate embodiments having fewer than, or more than, all of the features described herein are possible. Functionality may also be, in whole or in part, distributed among multiple components, in manners now known or to become known. Thus, myriad software/hardware/firmware combinations are possible in achieving the functions, features, interfaces and preferences described herein. Moreover, the scope of the present disclosure covers conventionally known manners for carrying out the described features and functions and interfaces, as well as those variations and modifications that may be made to the hardware or software or firmware components described herein as would be understood by those skilled in the art now and hereafter.

An aspect of the present disclosure is the storage on computer readable media, such as magnetic disks or drives, such as a hard drive, a thumb drives, RAM or ROM of a program for controlling a winch including the steps of controlling an electric motor driven by a source of electricity that passes through a switching device having an ON state in which electricity flows through the electric motor and an OFF state in which electricity does not flow through the electric motor. A portion of the program may be stored and/or is accessible by a base unit having a microprocessor and a transceiver and which is electrically connected to the electrical switching device, outputs from the base unit controlling the ON/OFF state of the switching device. A portion of the program may be stored in a hand-held unit, the hand-held unit having a microprocessor, a transceiver and a display, the transceivers of the base unit and the hand-held unit supporting wireless communication between the base unit and the hand-held unit, the hand-held unit having a control panel. At least one sensor senses an operating parameter of the winch, the sensor having an output interpretable by the programmed computer of the base unit. After establishing a wireless connection between the hand-held unit and the base unit, commands may be entered on the control panel of the hand-held unit, the programmed microprocessor of the hand-held unit converting the commands into wirelessly transmissible control signals interpretable by the base unit. The program permits receiving sensor data from the sensor in the microprocessor of the base unit and converting the sensor data into wirelessly transmissible sensor data interpretable by the hand-held unit and transmitting the control signals from the hand-held unit to the base unit. The program permits receiving the control signals into the base unit, the programmed microprocessor of the base unit interpreting the control signals and generating outputs to the switching device, the outputs controlling the ON/OFF state of the switching device, transmits the sensor data from the base unit to the hand-held unit and displays the operating parameter on the display to apprise a user.

It will be understood that the embodiments described herein are merely exemplary and that a person skilled in the art may make many variations and modifications without departing from the spirit and scope of the disclosed subject matter. All such variations and modifications are intended to be included within the scope of the disclosure and claims.

We claim:

1. A winch system, comprising:

an electric motor electrically coupled to a switching device having an ON state in which electricity flows through the electric motor and an OFF state in which electricity does not flow through the electric motor;

a base unit electrically coupled to the switching device to control the switching device;

at least one sensor operably coupled to the base unit, the sensor being configured to sense an operating parameter of the electric motor and deliver a sensor output to the base unit; and a hand-held unit in communication with the base unit, the hand-held unit including:

a display device;

an audio interface; and a microprocessor programmed to analyze winch performance based at least in part on the sensor output and issue a corresponding winch performance notification via at least the audio interface.

2. The system of claim 1, wherein the base unit and the hand-held unit each include a transceiver to provide wireless communication between the base unit and the hand-held unit.

3. The system of claim 2, wherein the display device comprises a touch sensitive display that displays a virtual control panel configured to receive input from the user.

4. The system of claim 3, wherein the hand-held unit includes a wireless telephone with access to a telephonic network and the Internet.

5. The system of claim 4, further comprising a server computer coupleable to the Internet, the server computer having access to winch data pertaining to the winch, the server computer being programmed to communicate the winch data to the hand-held unit and receive data from the hand-held unit.

6. The system of claim 1, wherein the at least one sensor is a temperature sensor positioned to sense a temperature of the electric motor.

7. The system of claim 1, wherein the at least one sensor is a current sensor positioned to sense an electrical current flow through the electric motor.

8. The system of claim 1, wherein the switching device is a first switching device, and wherein the system further comprises a second switching device electrically coupled to the electric motor to change a polarity of the electricity flowing through the electric motor and a direction that the electric motor spins.

9. The system of claim 1, wherein the switching device includes a relay.

10. The system of claim 1, wherein the hand-held unit further comprises a haptic interface coupled to the microprocessor to issue the winch performance notification.

11. The system of claim 1, wherein the audio interface is configured to issue the notification as a spoken message.

12. The system of claim 1, wherein the audio interface is configured to issue the notification as a sound with a varying volume and/or pitch.

13. A method for controlling a winch, comprising:

providing an electric motor electrically coupled to a switching device having an ON state in which electricity flows through the electric motor and an OFF state in which electricity does not flow through the electric motor;

providing a base unit including a microprocessor and a transceiver;

electrically coupling the base unit to the switching device, wherein output signals from the base unit control the ON/OFF state of the switching device;

providing at least one sensor configured to sense an operating parameter of the electric motor and output sensor data to the base unit, wherein the base unit is configured to:

transmit the sensor data to a hand-held unit;

receive control signals from the hand-held unit; and interpret the control signals and generate the output signals for controlling the ON/OFF state of the switching device; and providing instructions for transmission to the hand-held unit, wherein the instructions cause the hand-held unit to issue a winch performance notification based at least in part on the sensor data.

14. The method of claim 13, wherein the instructions further comprise instructions for displaying the operating parameter on a display of the hand-held unit.

15. The method of claim 14, wherein the sensor data includes electrical current draw; and wherein the instructions further comprise instructions for transmitting winch data to the hand-held device, the winch data including a power curve for the winch approximated by an equation expressed in terms of electrical current draw; and inferring at least one of the load or winch speed from the equation and the sensor data and displaying the inferred value on the display of the hand-held unit.

16. The method of claim 15, wherein the instructions further comprise instructions for developing the power curve including, plotting test data noted during empirical testing of a winch on a graph resulting in an empirical line and fitting a line having an associated equation to the empirical line.

17. The method of claim 16, wherein the fitted line has an associated equation of the point-slope form.

18. The method of claim 16, wherein the fitted line has an associated equation of the polynomial or exponential type.

19. The method of claim 15, wherein the instructions further comprise instructions for cumulatively recording the sensor data on the hand-held unit and comparing the sensor data to known operational boundary conditions.

20. The method of claim 19, wherein the instructions further comprise instructions for uploading the sensor data from the hand-held device to a server computer.

21. The method of claim 20, wherein uploading the sensor data is conducted multiple times from multiple hand-held devices, resulting in a database from which generalized characteristics of a particular winch can be observed based upon actual use.

22. The method of claim 13, wherein the instructions further comprise instructions for using a haptic interface of the hand-held unit to issue the winch performance notification.

23. The method of claim 13, wherein the instructions further comprise instructions for using an audio interface of the hand-held unit to issue the winch performance notification.

24. The method of claim 23, wherein the instructions further comprise instructions for using the audio interface to provide a spoken message to issue the winch performance notification.

25. The method of claim 23, wherein the instructions further comprise instructions for using the audio interface to provide a sound with a varying volume and/or pitch to issue the winch performance notification.

26. A winch system, comprising:

an electric motor electrically coupled to a switching device having an ON state in which electricity flows through the electric motor and an OFF state in which electricity does not flow through the electric motor;

a base unit electrically coupled to the switching device to control the switching device;

at least one sensor operably coupled to the base unit, the sensor being configured to sense an operating parameter of the electric motor and deliver a sensor output to the base unit; and a hand-held unit in communication with the base unit, the hand-held unit including:

a display device;

a haptic interface; and a microprocessor programmed to analyze winch performance based at least in part on the sensor output and issue a corresponding winch performance notification via at least the haptic interface.

27. The system of claim 26, wherein the base unit and the hand-held unit each include a transceiver to provide wireless communication between the base unit and the hand-held unit.

28. The system of claim 27, wherein the display device comprises a touch sensitive display that displays a virtual control panel configured to receive input from the user.

29. The system of claim 28, wherein the hand-held unit includes a wireless telephone with access to a telephonic network and the Internet.

30. The system of claim 26, wherein the hand-held unit comprises a wired remote controller.

31. The system of claim 26, wherein the at least one sensor is a temperature sensor positioned to sense a temperature of the electric motor.

32. The system of claim 26, wherein the at least one sensor is a current sensor positioned to sense an electrical current flow through the electric motor.

* * * * *